United States Patent [19]

Mansour

[11] Patent Number: 4,618,323

[45] Date of Patent: Oct. 21, 1986

[54] METHOD AND BURNER TIP FOR SUPPRESSING EMISSIONS OF NITROGEN OXIDES

[75] Inventor: Mansour N. Mansour, Hacienda Heights, Calif.

[73] Assignee: Southers California Edison, Rosemead, Calif.

[21] Appl. No.: 638,295

[22] Filed: Aug. 6, 1984

Related U.S. Application Data

[62] Division of Ser. No. 122,690, Feb. 19, 1980, Pat. No. 4,505,665.

[51] Int. Cl.[4] ..... F23C 5/08

[52] U.S. Cl. ..... 431/177; 431/163; 431/187; 431/10; 431/284

[58] Field of Search ..... 431/2, 4, 8, 9, 10, 431/163, 168, 174, 177, 180, 181, 187, 188, 190, 284, 351; 239/422, 425, 427.5, 434, 549

[56] References Cited

U.S. PATENT DOCUMENTS

| | | | |
|---|---|---|---|
| 911,587 | 5/1964 | Grow | 431/177 |
| 1,184,985 | 5/1916 | Nystrom | 239/549 |
| 1,934,837 | 11/1933 | Zulver . | |
| 2,011,283 | 8/1935 | Huff . | |
| 3,133,731 | 5/1964 | Reed | 431/187 |
| 3,176,749 | 4/1965 | Downs | 431/168 |
| 3,182,712 | 5/1965 | Zink et al. . | |
| 3,758,258 | 9/1973 | Kolhi . | |
| 3,787,168 | 1/1974 | Koppang et al. | 431/177 |
| 3,880,571 | 4/1975 | Koppang et al. | 431/177 |
| 4,023,921 | 5/1977 | Anson | 431/9 |

FOREIGN PATENT DOCUMENTS

| | | |
|---|---|---|
| 184285 | 8/1922 | United Kingdom . |
| 193859 | 5/1924 | United Kingdom . |
| 228980 | 2/1925 | United Kingdom . |
| 313830 | 6/1929 | United Kingdom . |
| 315252 | 7/1929 | United Kingdom . |
| 518496 | 2/1940 | United Kingdom . |
| 620073 | 3/1949 | United Kingdom . |
| 682576 | 11/1952 | United Kingdom . |
| 739732 | 11/1955 | United Kingdom . |
| 791225 | 2/1958 | United Kingdom . |
| 913807 | 12/1962 | United Kingdom . |
| 979102 | 1/1965 | United Kingdom . |
| 1188761 | 4/1970 | United Kingdom . |
| 1499680 | 2/1978 | United Kingdom . |
| 1533386 | 11/1978 | United Kingdom . |

OTHER PUBLICATIONS

B. P. Breen, "The Practice of Flames in Large Utility Boiler Operation", NOx Control Technology Workshop, Asilomar, Calif., Oct. 1977.

M. P. Heap, G. C. England, J. W. Lee, D. W. Pershing and G. B. Martin, "Combustion Modification . . . Parameters", ASME Air Pollution Control Division, 78-WA/APC-13, Dec. 1978.

A. F. Sarofim, J. H. Pohl, and B. R. Taylor, "Mechanisms and Kinetics of NOx Formation: Recent Developments", 69th Annual Meeting, AIChE, Nov. 1978.

*Primary Examiner*—Carroll B. Dority, Jr.
*Attorney, Agent, or Firm*—Sheldon & Mak

[57] ABSTRACT

A method and burner tip for suppressing the production of oxides of nitrogen when burning a fuel in a combustion chamber containing a flame zone are described. The burner tip comprises at least one port for introducing fuel into the combustion zone and at least one port for introducing a control gas into the combustion zone, where both the fuel and control gas are introduced substantially perpendicular to the direction of introduction of combustion gas into the combustion zone. The ports are laterally spaced apart from each other. The control gas is used for controlled localized quenching of the flame zone and/or for controlled atomization of the fuel in the case of the liquid fuel to reduce the emissions of nitrogen oxides (NOx). By proper selection of the size and location of the fuel and control gas ports, and the quantity and velocity of the fuel and control gas introduced into the combustion zone, a stable flame with minimal emission of oxides of nitrogen can be obtained.

40 Claims, 29 Drawing Figures

EFFECT OF ATOMIZATION STEAM GAP SIZE AND LOCATION ON $NO_X$ EMISSION

EFFECT OF ATOMIZATION STEAM GAP LOCATION ON $NO_X$ EMISSION

EFFECT OF STEAM EXITING MOMENTUM ON $NO_X$ EMISSION

COMPARISON BETWEEN PEABODY BURNER AND LOW $NO_x$ BURNER

CONVERSION EFFICIENCY OF FUEL BOUND NITROGEN TO $NO_X$

EFFECT OF TYPE OF CONTROL GAS ON $NO_X$ EMISSION FROM HIGH NITROGEN CONTENT FUEL

EFFECT OF TYPE OF CONTROL GAS ON SMOKE LIMIT OF HIGH NITROGEN CONTENT FUEL

COMPARISON BETWEEN PRIOR ART BURNERS AND LOW $NO_X$ BURNERS

METHOD AND BURNER TIP FOR SUPPRESSING EMISSIONS OF NITROGEN OXIDES

This is a division of application Ser. No. 122,690, filed Feb. 9, 1980 U.S. Pat. No. 4,505,665.

BACKGROUND

The present invention is directed to a method for burning a fuel and a burner tip for burning of the fuel which permits suppression of generation of oxides of nitrogen (NOx).

Historically, the principal goals in burning a fuel for processes utilizing the heat of combustion were the operational goals of maintenance of stable combustion and maximum combustion efficiency and fuel utilization. More recently, due to environmental considerations, the emphasis has shifted to balancing those goals with the reduction of combustion emissions, especially particulate and NOx emissions. Substantial efforts have been and are being made to minimize and suppress particulate and NOx emissions when burning a fuel. Unfortunately, suppression of NOx emissions often results in failure to meet the operational goals of burner flame stability and efficient utilization of the fuel, as well as the goal of low particulate emissions.

To improve burner flame stability and combustion efficiency, intimate mixing between combustion air and fuel traditionally has been encouraged. However, in the development of the invention described herein, it has been determined that this intensified mixing contributes to a significant increase in NOx emission.

Attempts have been made to reconcile the conflicting goals of low NOx emission versus flame stability, high fuel utilization and efficiency, and low particulate emissions (smoke). U.S. Pat. Nos. 3,787,168 and 3,880,571 issued to Koppang et al and assigned to TRW, Inc. are directed to a solution of these conflicting goals.

These patents describe a burner hardware which controls NOx emission by reducing the contact time of the hot nitrogen molecules with atmospheric oxygen and conducting the combustion process at a low temperature. To achieve these objectives the invention teaches the use of improved fuel atomization and mixing of the reactants to complete the combustion rapidly and therefore reduce the residence time to a minimum for the reacting species that produce NOx. The reduction of flame temperature is accomplished by radiating heat away from the flame and by diluting the bulk of the reactants with an inert gas. The patents describe a distribution tube for radial introduction of a mixture of a fuel and a mixing gas into the combustion gas. A deflector disk is affixed to the end of the distribution tube to maximize the mixing intensity between the fuel and the oxidizer and to control the shape of the flame zone established. Another deflector may be suspended from the deflector disk for deflecting axially introduced cooling gas in a radial direction outwardly along the trajectory of the flame to carry away heat.

Because of increasingly strict regulations regarding NOx emissions from stationary sources, the assignee of the present invention contracted with TRW to apply the technology described in the aforementioned patents in its electrical generating plants. The burner tip configurations actually tested were later developments of what is described in the aforementioned patents.

The TRW burner technology was demonstrated in a utility boiler in tests conducted by SCE and TRW Research scientists and engineers. These tests showed that use of intense mixing for improved fuel atomization as taught by the TRW patents does not result in a low level of NOx emissions, but rather results in a high level of NOx emissions. It was also shown that completing the combustion process near homogeneous stoichiometric conditions, by intensifying the mixing process, as described in the TRW patents further increases NOx emissions. Burner features that were identified, after two years of extensive testing under the SCE-funded program to reduce NOx production, were described by D. B. Sheppard in "Low-NOx Burner Presentation", NOx Workshop and Assessment of Control Technology for Oil-and-Gas Fired Utility Boilers, October, 1977, Sigma Research, Inc., Richland Wash., pages 53–65. As reported in that paper, a new burner tip was used that did away with the deflector disk. In the new burner tip, atomizing steam was introduced through an annular passage surrounding a central oil passage. Oil flowed axially through the oil passage into a distribution chamber from which it was injected radially from orifices coaligned with steam orifices. The orifice pairs consisting of a steam orifice and an oil orifice were arranged circumferentially around the burner tip. Results of the studies with this type of burner tip are described in reports prepared by TRW entitled "Low NOx Burner Development Program", Final Report, January , 1976; "Low NOx Burner Development Program", Phase Two Final Report, June, 1976; and "Low NOx Burner Development Program", Phase Three Final Report, December, 1976. Each of these three reports accompanies this specification.

Another TRW suggested concept was the use of a two-stage burner gun where fuel is fed through two separate concentric annular passages, each terminating at laterally spaced apart orifices along the burner tip. The fuel is still atomized by gas introduced through coaligned orifices. Results obtained with this burner gun are reported in a report entitled "Low NOx Burner Development Program; Advanced LNB Program"; M1-J Test Facility Program, Aug. 25, 1978.

It was found that the various TRW burner tips were able to reduce NOx emissions from a utility boiler, without adversely affecting flame stability and fuel utilization efficiency. However, several deficiencies in the burner tip design were noted. For example, there was a tendency for carbon to accumulate around the steam orifices, thereby plugging the orifices and eventually the burner throat. In addition, large quantities of steam were required for atomization, in the range of 10–20% by weight of the oil flow rate. Furthermore, due to the use of concentric and aligned orifices, the burner tip assembly was bulky and heavy, which made it difficult to install and service. And finally, and most importantly, although there was a reduction in NOx as compared to the original equipment burner assemblies provided with the boiler, which used mechanical atomization and axial introduction of the oil, an even greater reduction in emissions was desired.

In view of the foregoing, it is apparent that there is a need for a method for burning fuel and a burner tip assembly which suppress NOx emissions, and which require minimal amounts of steam, where the burner tip prevents carbon deposits from forming in injection orifices. In addition, it is desirable that the burner tip be of small size and light weight.

SUMMARY

The present invention is directed to a method and a burner tip for burning a fuel in a combustion chamber, the method and burner tip having the above features. According to one version of the method, an oxygen containing combustion gas is introduced into a combustion zone such as the furnace of a boiler, the combustion zone also containing a flame zone. The fuel is injected into the combustion zone at an angle substantially perpendicular to the direction of introduction of the combustion gas. It is preferred that the fuel be ejected from the burner tip by itself without any other gas, i.e., the fuel is ejected as a coherent mass without any atomization other than that normally achieved when fuel is ejected from an orifice.

Simultaneously with the introduction of the fuel, a control gas is introduced into the combustion zone from gas port in the burner tip, the gas port being laterally spaced from the fuel port. The control gas also is introduced at an angle substantially perpendicular to the direction of introduction of the combustion gas. The control gas serves to locally quench the flame zone. Preferably the control gas intercepts the flame zone at the point closest to where the combustion gas is introduced, which generally is where the highest NOx production occurs. In the case of a liquid fuel which is introduced to the combustion zone without prior atomization, the control gas is introduced at a sufficient rate and a sufficient velocity for controlled atomization of the fuel without unduly increasing the mixing intensity within the flame zone to achieve NOx control without sacrificing burner flame stability.

An important feature of the method and the burner tip of the present invention is that the amount and location of the quenching of the flame zone, the degree of fuel atomization, and the level of mixing within the flame zone, can be controlled. As a result, the burner can reconcile the conflicting goals of: (1) suppression of the production of oxides of nitrogen; (1) maintenance of flame stability; and (3) efficient fuel utilization. Burner parameters that can be varried for these goals include: the number, location, size, and configuration of the fuel ports; the number, location, size, and configuration of the control gas ports; the type of control gas; and the angle at which the control gas and fuel are injected into the combustion chamber.

For example, the mixing intensity of the fuel with combustion gas within the flame-zone can be controlled by changing the proximity of the control gas port to the fuel port, and the velocity and mass flow rate of the control gas. To avoid excess atomization of a liquid fuel, preferably the control gas port is laterally spaced apart from the fuel port a sufficient distance that the control gas does not intersect the fuel until the fuel enters the flame zone. The control gas mass and velocity can be independently changed by separately regulating the feed pressure and port discharge areas for the gas. Reduction of the flame temperature while maintaining the required flame stability also are achieved by changing these burner variables.

In one application of the method and burner tip of the present invention, fuel having a relatively high nitrogen content is burned in the presence of a fuel of relatively lower nitrogen content. Each fuel can be introduced independently through a fuel port, where the fuel port for the fuel of the higher nitrogen content is on the downstream side of the port where the combustion gas is introduced. Thus, the fuel of higher nitrogen content is burned in the presence of a lower concentration of oxygen than is the fuel of lower nitrogen content. Since fuel nitrogen conversion to NOx is inversely proportional to the oxygen concentration in which a fuel is burned, this helps suppress production of oxides of nitrogen from the high nitrogen content fuel.

In one version of the present invention, the burner tip can have a single fuel port with three gas ports. A pair of gas ports are located on either side of the fuel port with the fuel port sandwiched therebetween. The third gas port is located further away from where the combustion gas is introduced than is the fuel port and the other two gas ports, i.e., the third gas port is on the downstream side of the other ports. The third gas port is spaced apart from the fuel port a sufficient distance that the control gas does not intersect the fuel until the fuel enters the flame zone, and generally by at least about 0.5 inch. The control gas introduced through the third gas port can be used for flame stablization and localized quenching of the flame zone, while the control gas introduced from the other two ports can be used for atomizing the liquid fuel. The fuel port preferably comprise a plurality of independent orifices spaced circumferentially about the burner tip in a plane perpendicular to the longitudinal axis of the burner tip, each orifice having a diameter from about 0.01 to about 0.1 inch, and preferably from about 0.02 to about 0.07 inch. Each gas port preferably is a slot circumferentially continuous around the burner tip, also in a plane perpendicular to the longitudinal axis of the burner tip, each slot having a width of from about 0.01 to about 0.1 inch, and more preferably from about 0.01 to about 0.05 inch.

Such a burner tip solves the problems with prior art burner tips. Namely, NOx emissions are reduced below the best that can be obtained with prior art burner tips, carbon deposits are eliminated, steam usage is reduced below 5% of the fuel flow rate when steam is used as the control gas, and both the size and weight of the burner tip are reduced.

DRAWINGS

These and other features, aspects and advantages of the present invention will become better understood with reference to the appended claims, following description, and accompanying drawings where:

FIG. 1 schematically shows a burner gun including a burner tip according to the present invention mounted in a boiler, the flame produced by the burner tip also being schematically presented;

Figure 5:
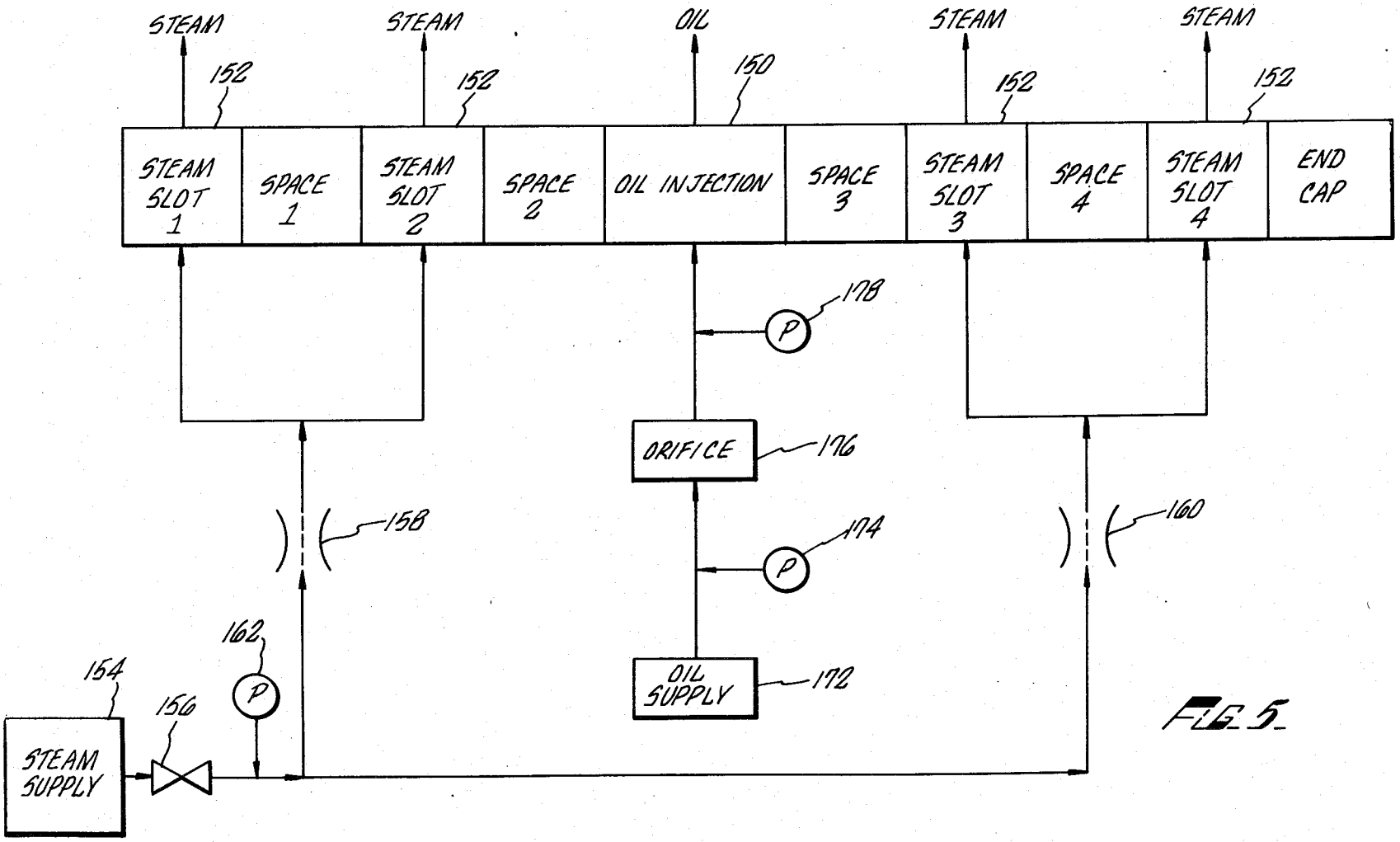
Figure 6A:
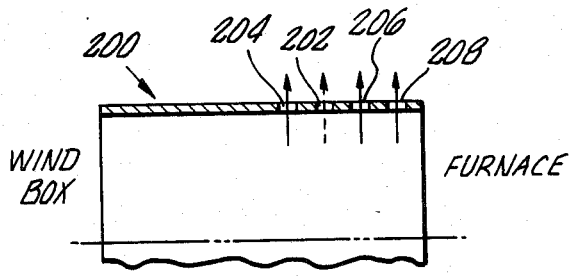
Figure 6B:
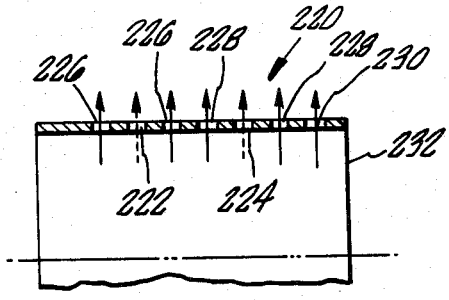
Figure 7A:
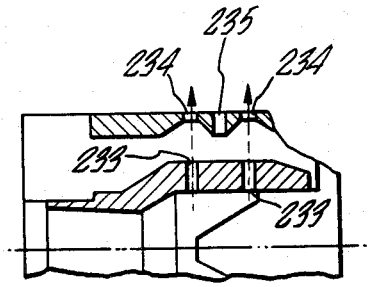
Figure 7B:
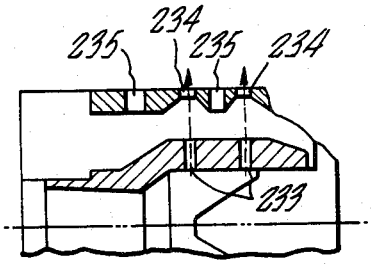
Figure 7C:
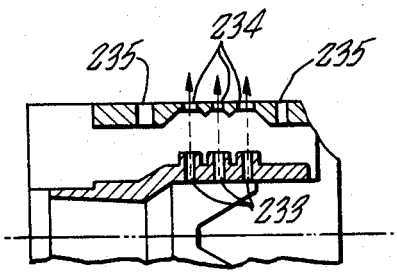
Figure 8:
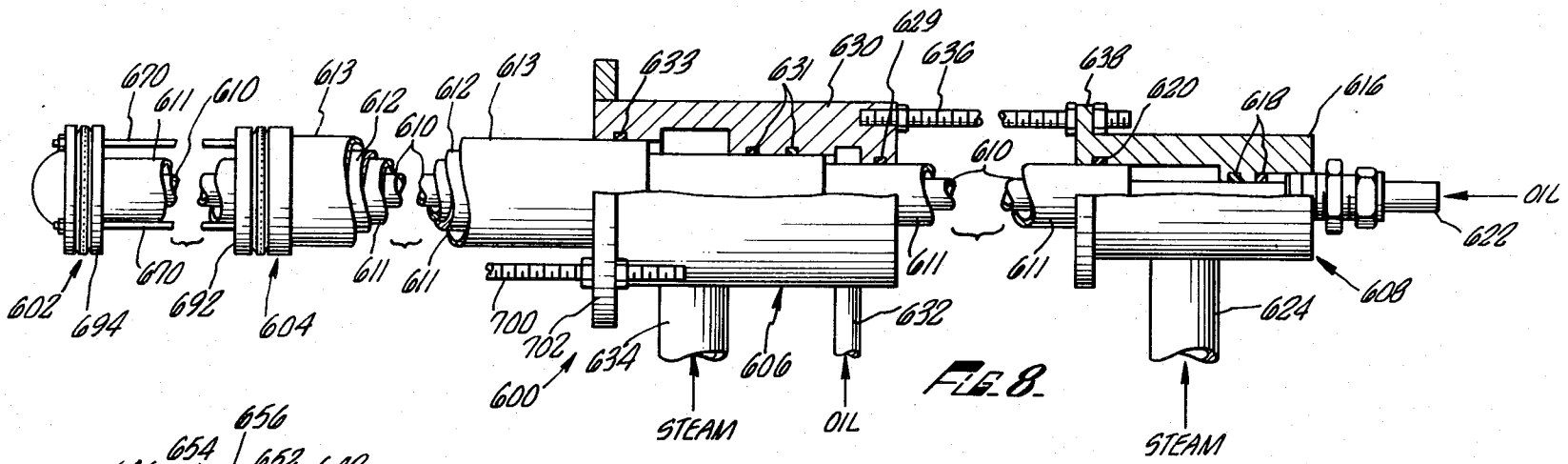
Figure 10:
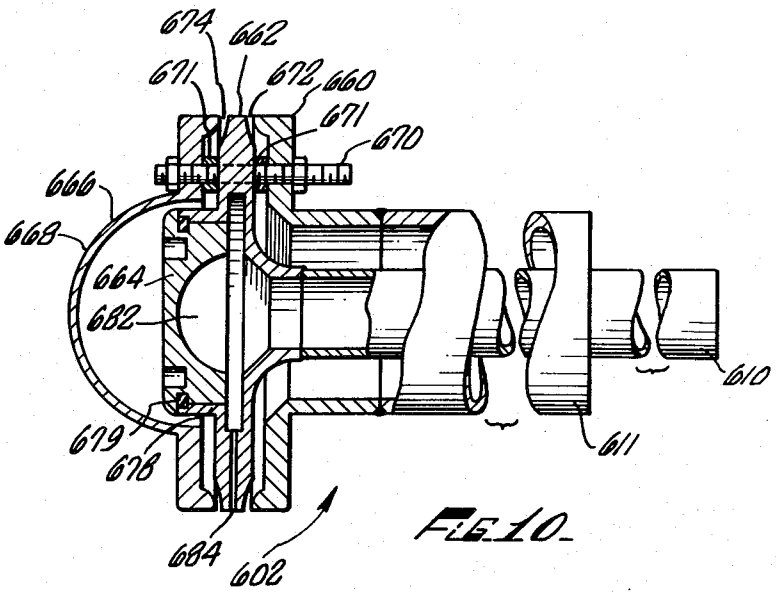
Figure 9:
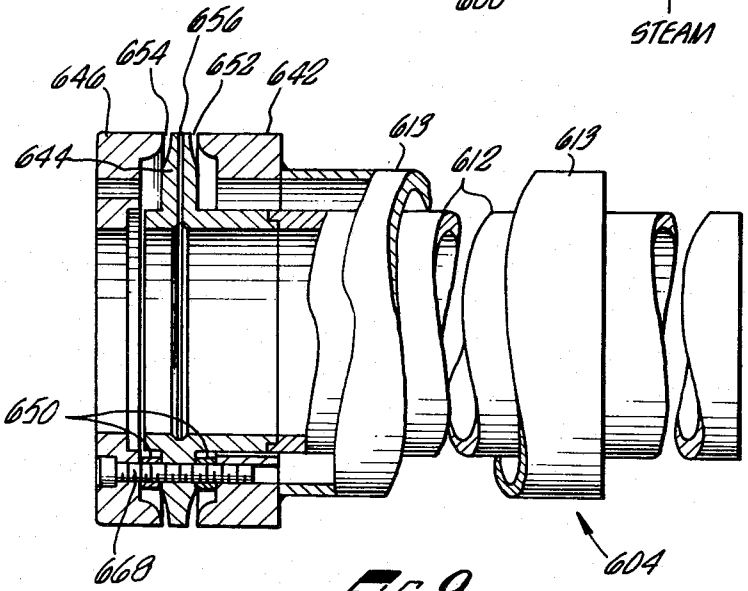
Figure 11:
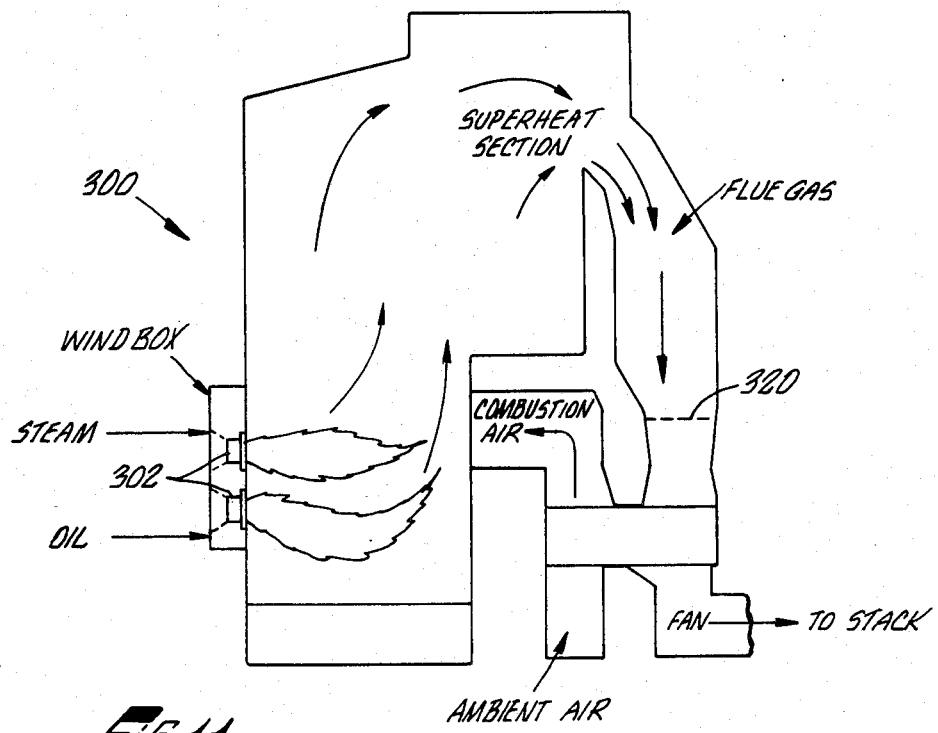
FIG. 11 PRIOR ART
Figure 12:
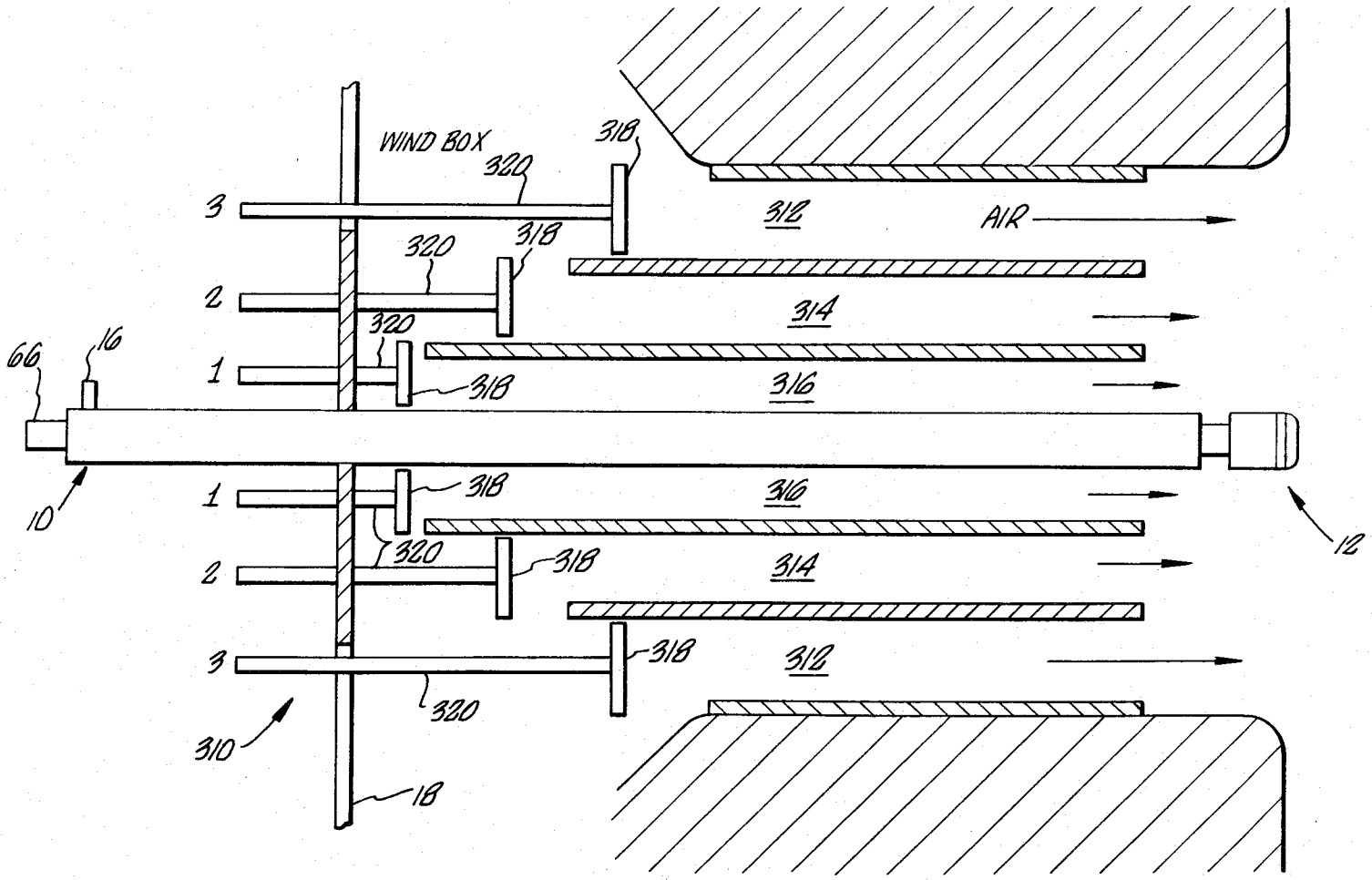
Figure 13:
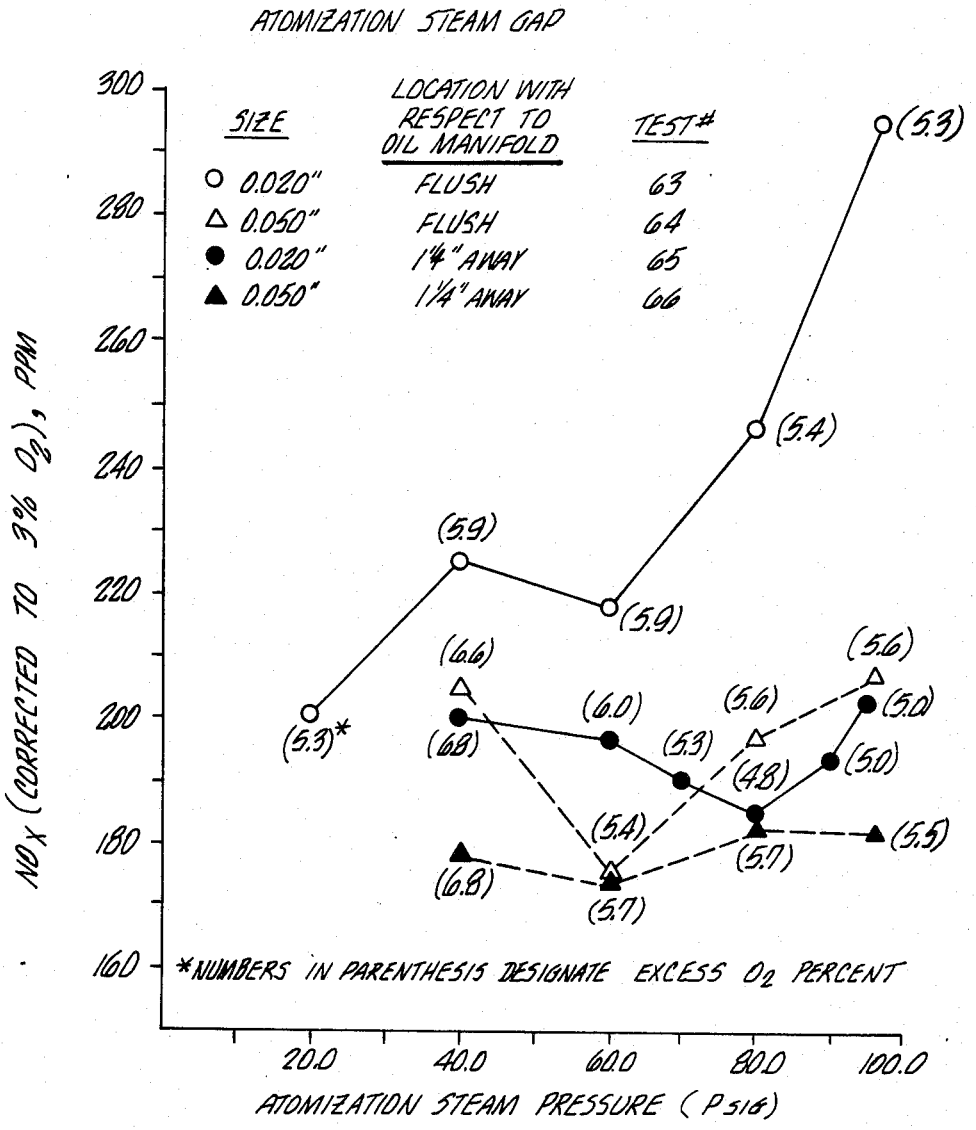
Figure 14:
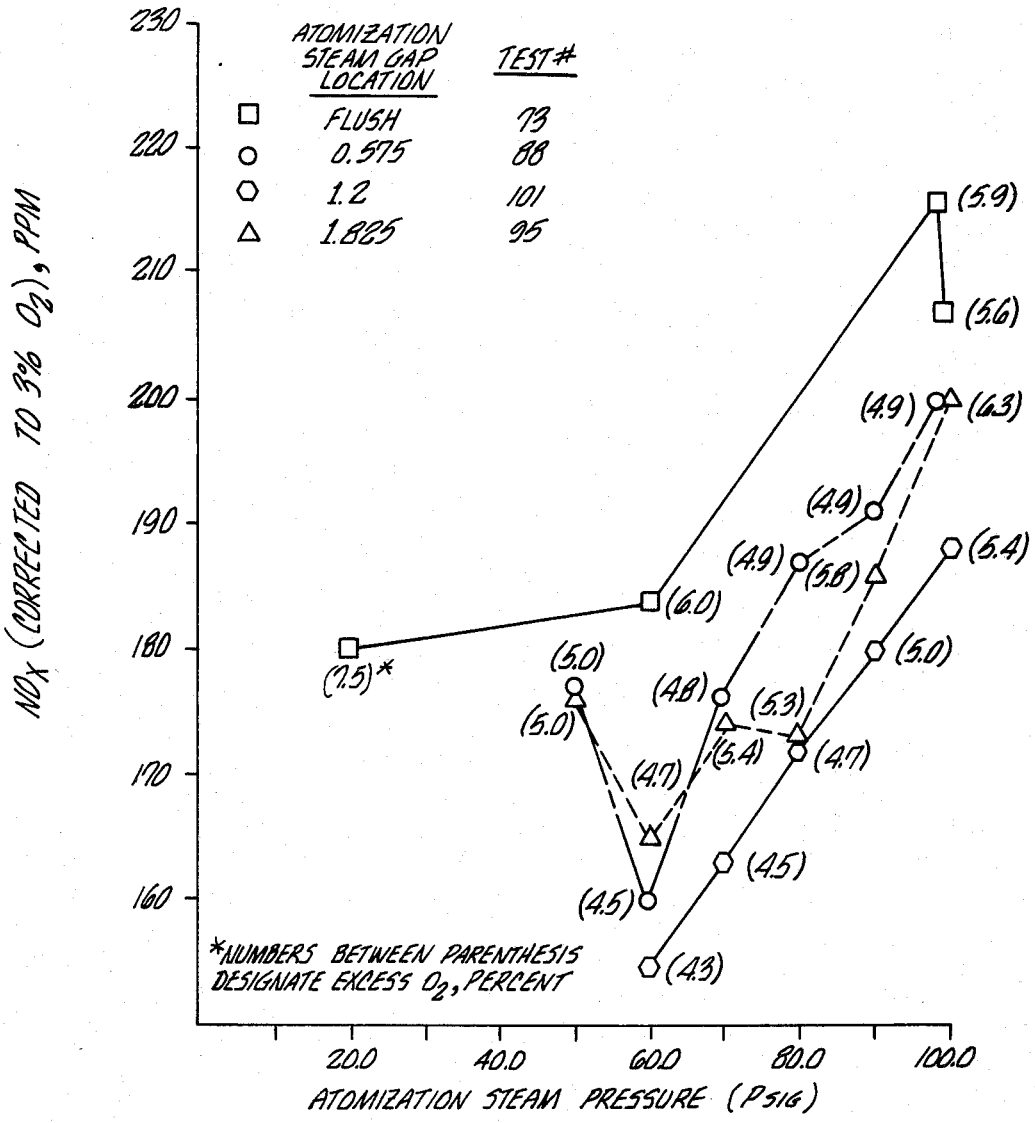
Figure 15:
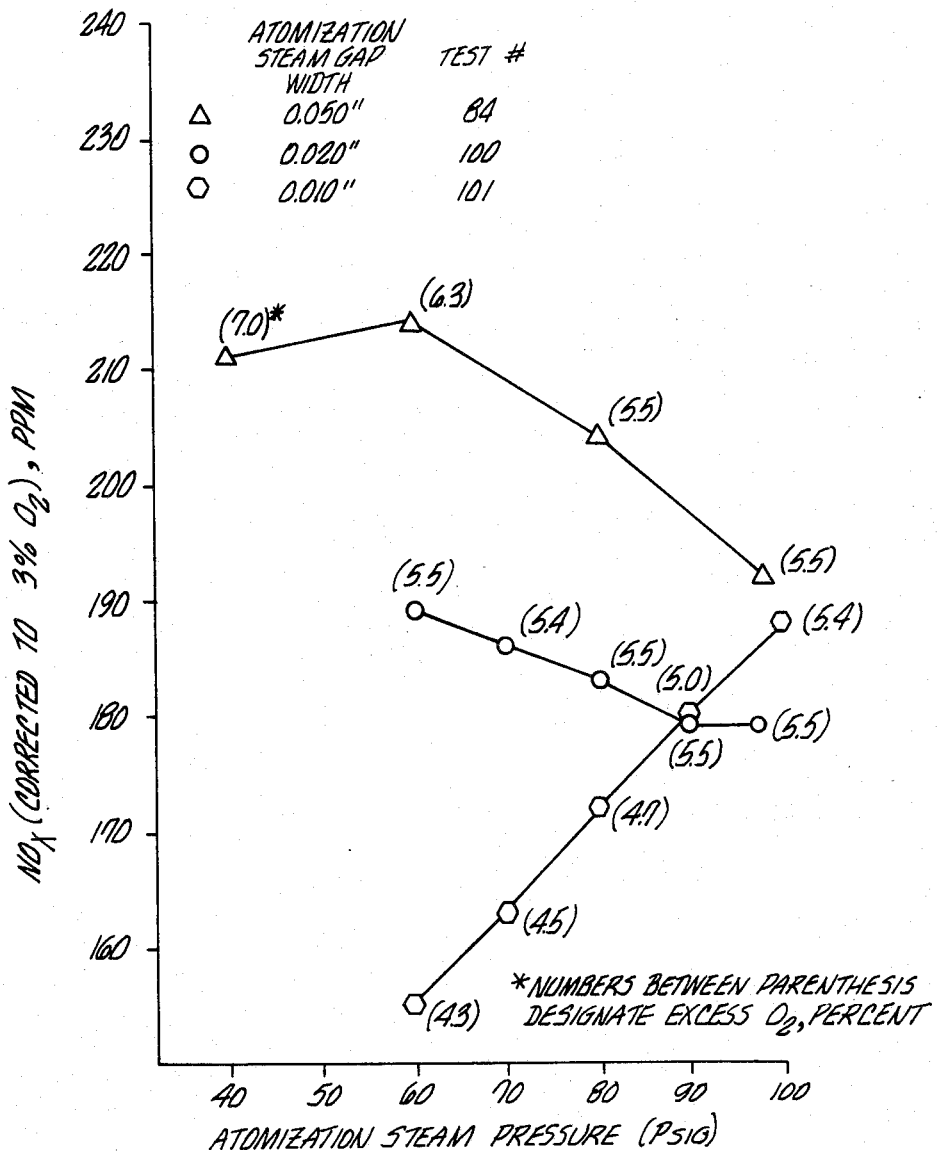
Figure 16:
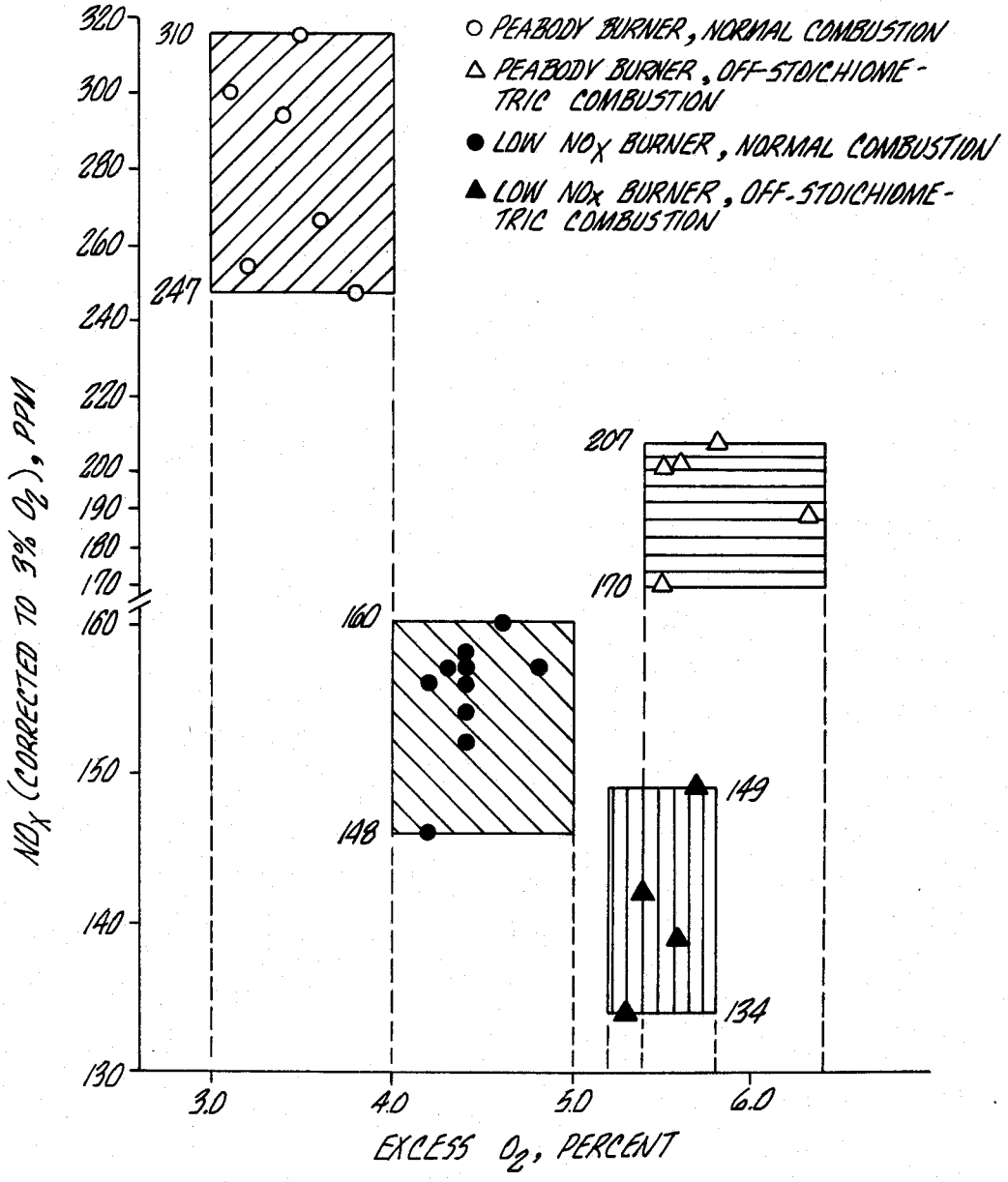
Figure 17:
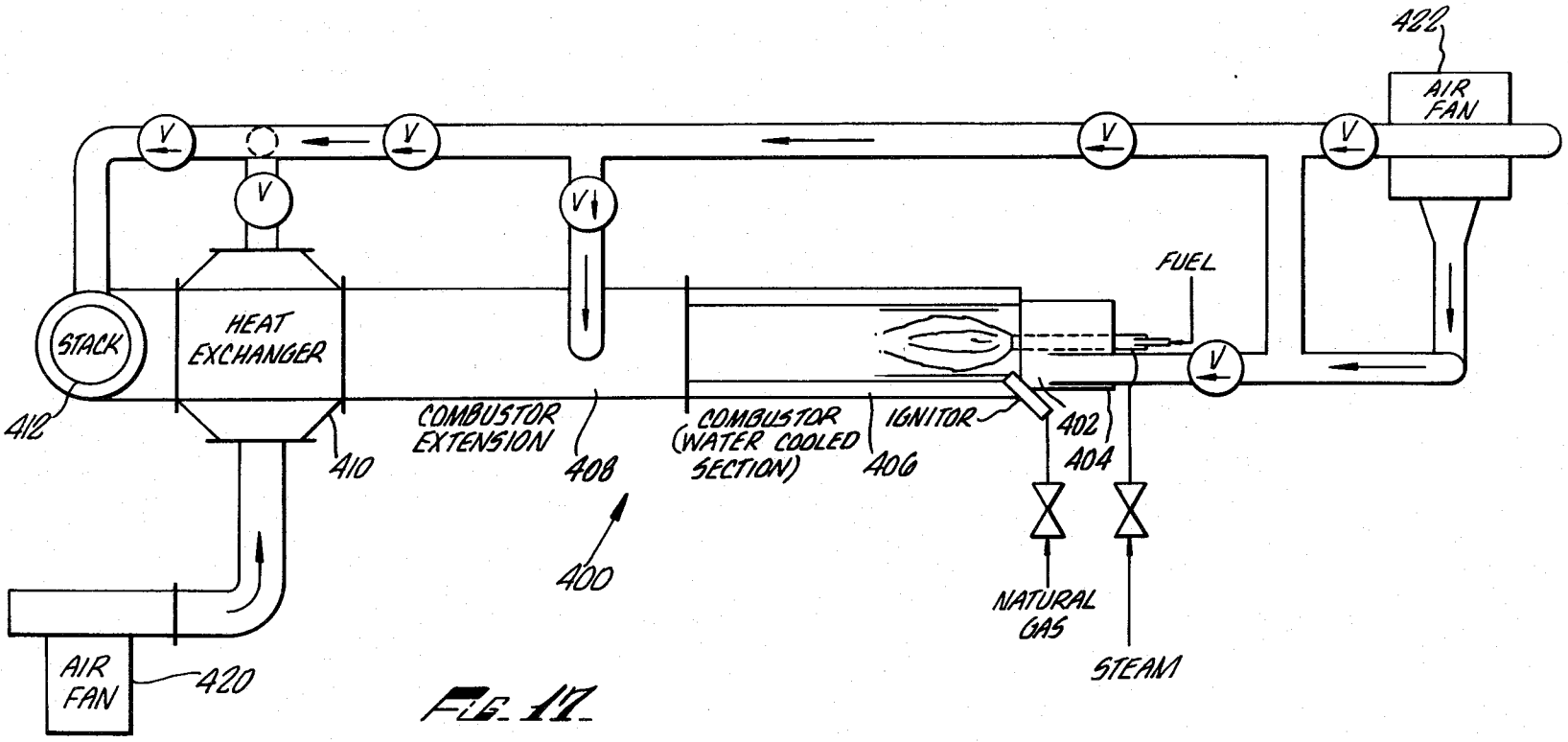
Figure 18:
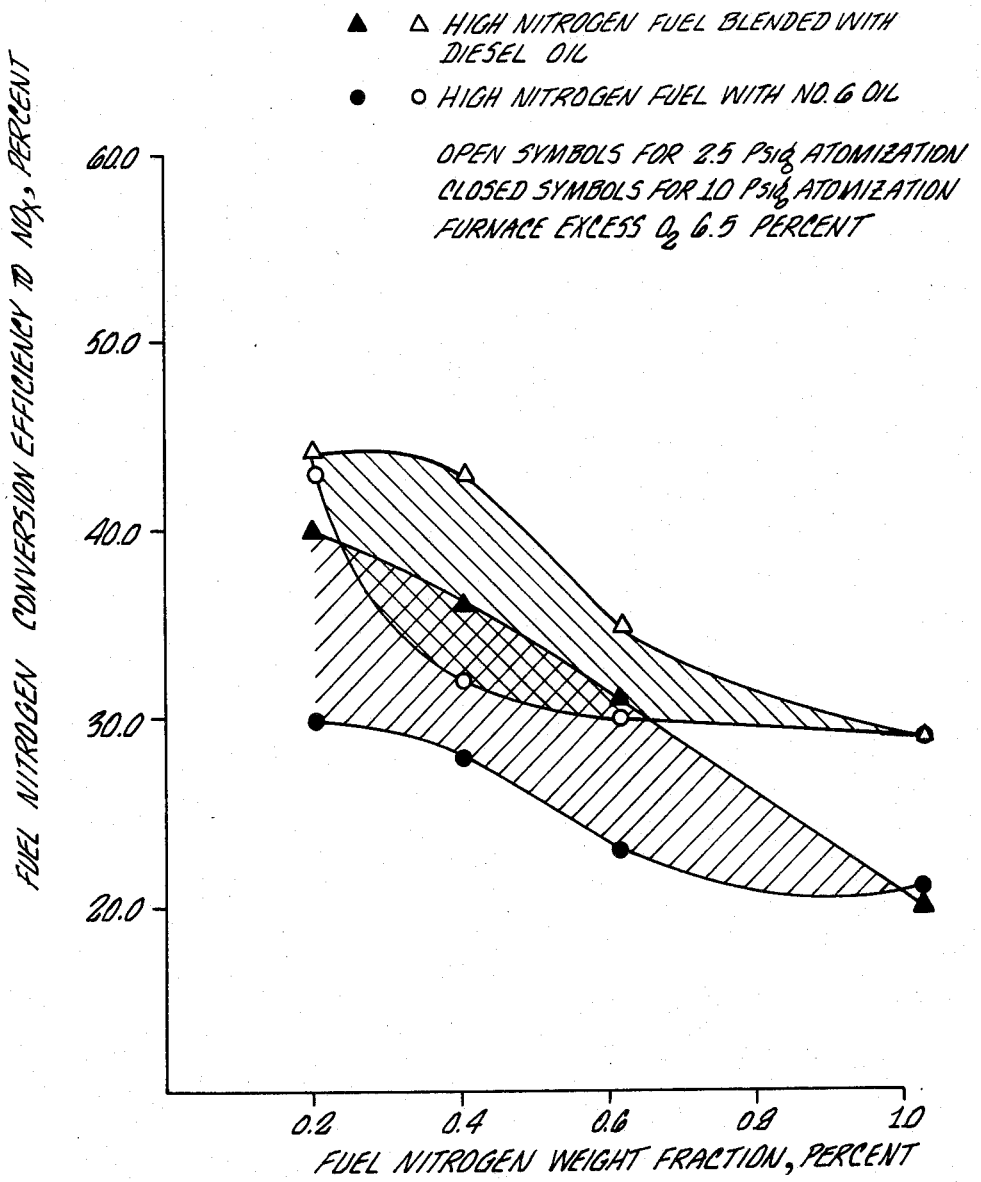
Figure 19:
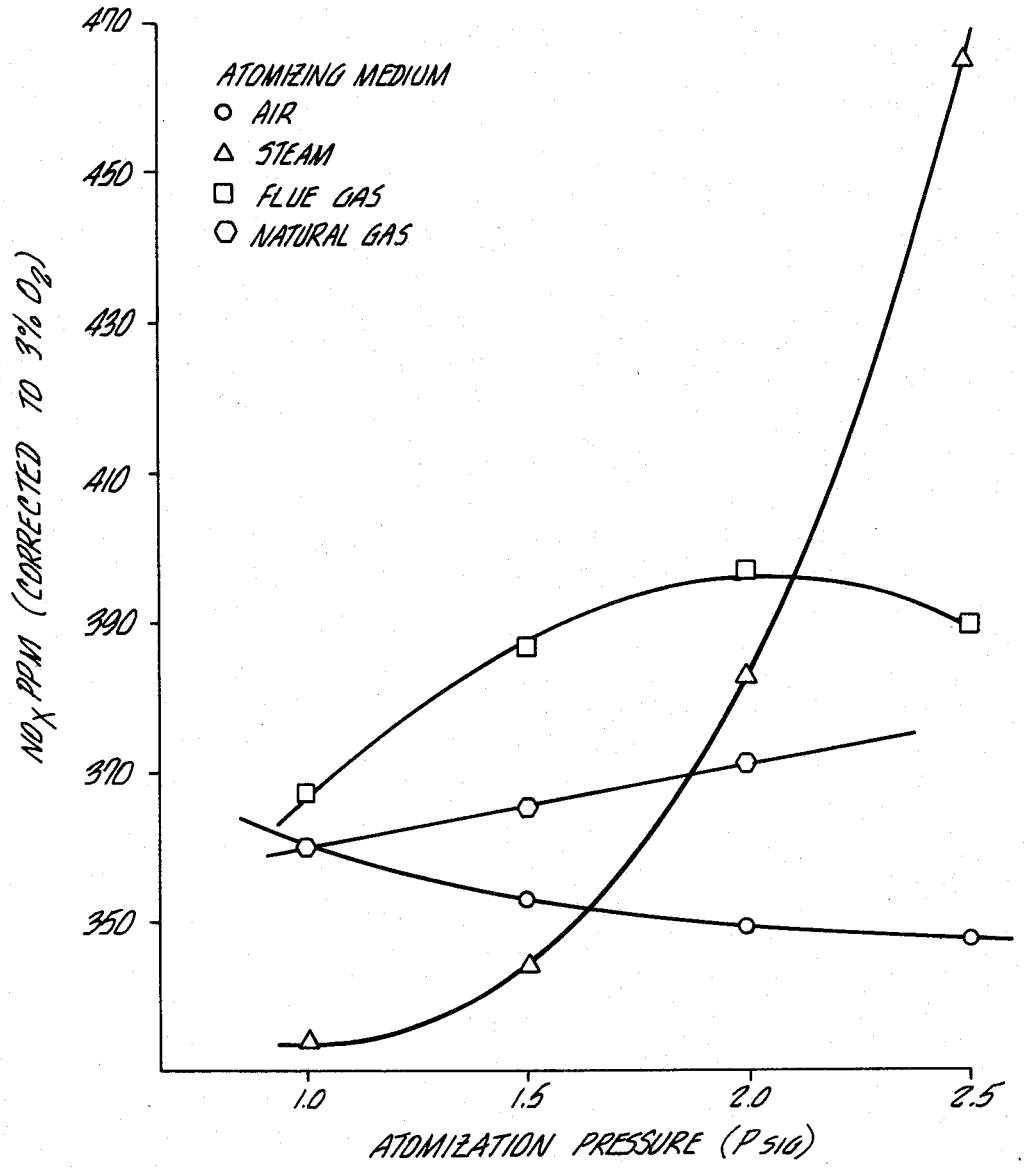
Figure 20:
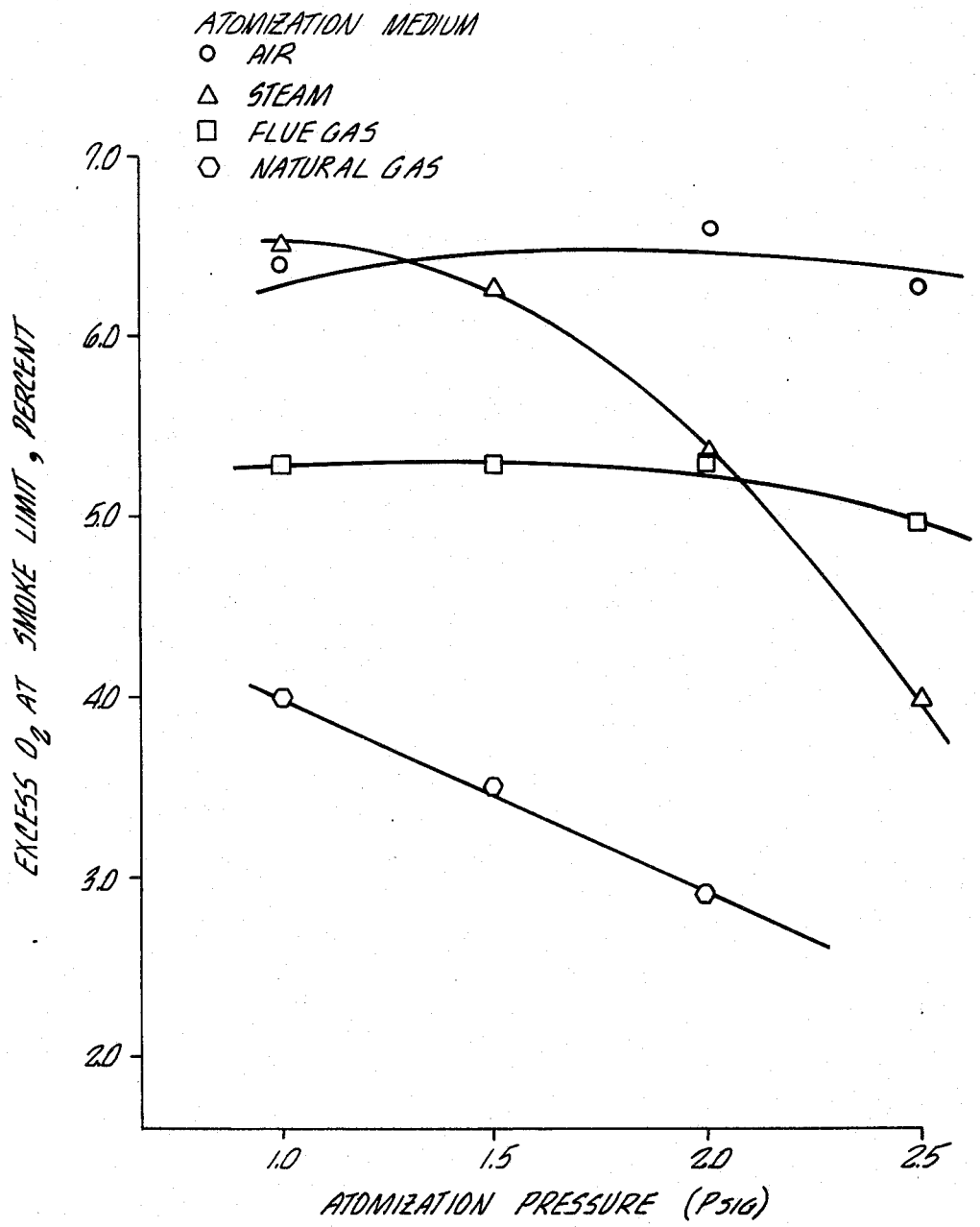
Figure 21A:
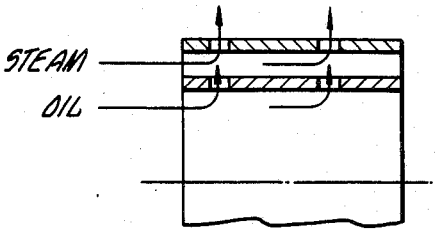
FIG 21A PRIOR ART
Figure 21B:
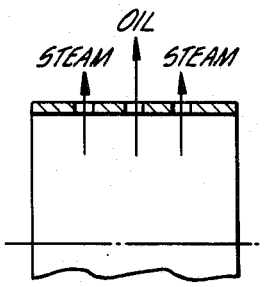
Figure 21C:
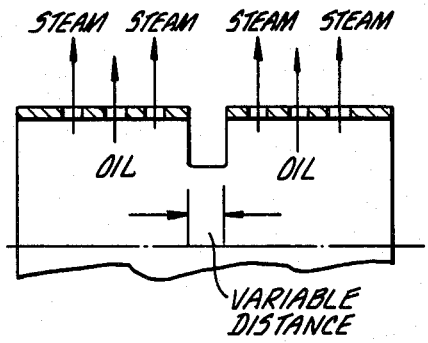
Figure 21D:
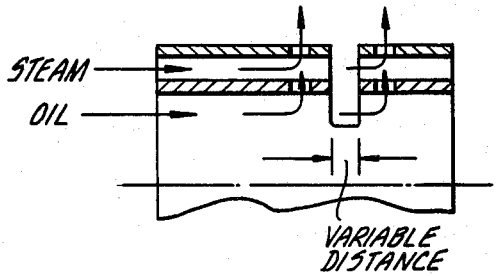
FIG 21D PRIOR ART
Figure 21E:
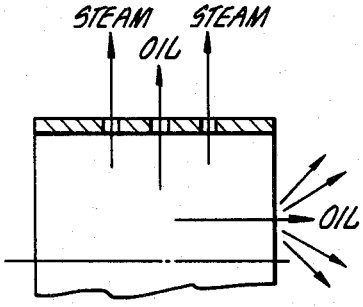
Figure 22:
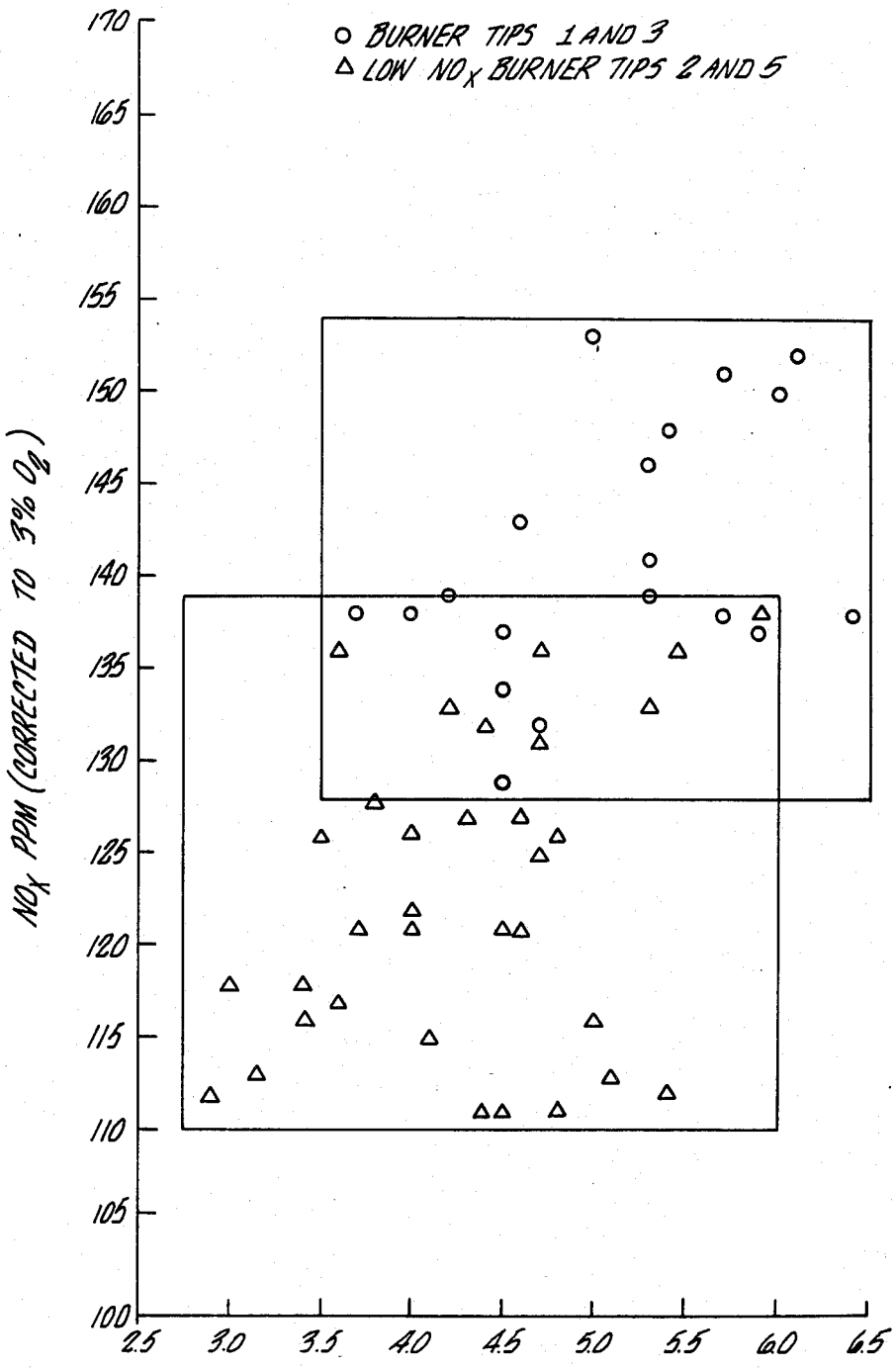

FIG. 5 schematically shows a burner tip having a single oil injection port and four steam injection slots;

FIGS. 6A and 6B schematically show other burner tips according to the present invention;

FIGS. 7A–7C schematically show burner tips according to the present invention where the burner tip includes coaligned oil and gas orifices;

FIG. 8 is a partial front elevation view of a burner gun having two burner tips according to the present invention, FIG. 9 is a longitudinal cross-sectional view of one of the burner tip assemblies of the burner tip of FIG. 8 and FIG. 10 is a longitudinal cross-sectional view of the other burner tip assembly of the burner tip of FIG. 8;

FIG. 11 schematically shows a utility boiler in which a burner tip according to the present invention was tested;

FIG. 12 shows an air register assembly which was used with the utility boiler of FIG. 11;

FIGS. 13 and 14 graphically present the effect of the size of the control gas slot and control gas slot location on NOx emissions;

FIG. 15 presents the effect of control gas exiting momentum on NOx emissions;

FIG. 16 graphically presents a comparison between the performance of burner tips according to the present invention on the utility boiler of FIG. 11 with the performance of the original equipment burners of the boiler;

FIG. 17 shows a schematic layout of a subscale combustion facility used to test burner tips according to the present invention;

FIG. 18 shows the conversion efficiency of fuel bound nitrogen into NOx as a function of the fuel nitrogen weight fraction using the burner tip of FIG. 10; and FIG. 19 shows the effect of the type of control gas on NOx emissions when burning a high nitrogen content fuel with the burner tip assembly of FIG. 10;

FIG. 20 shows the effect of the type of control gas on the smoke limit of a high nitrogen content fuel;

FIGS. 21A–21E schematically show burner tips tested, the tests demonstrating the superiority of the method and burner tip of the present invention; and FIG. 22 graphically presents a comparison between the performance of burner tips according to the present invention with the performance of prior art TRW burner tips.

DESCRIPTION

I INTRODUCTION AND DEFINITIONS

The present invention is directed to a novel method and a novel burner tip for burning of fluid fuels in a furnace. The method and burner tip reduce emissions of nitrogen oxides without adversely affecting the efficiency of fuel utilization and flame stability. This invention is based on the discovery that as fuel atomization and the level of mixing within a burner flame increase, invariably higher NOx emissions result. Prior to this invention, it had been the opinion of many, as evidenced by U.S. Pat. Nos. 3,787,168 and 3,880,571 issued to Koppang et al, that it is desirable to break up a liquid fuel with an atomizing gas into a fine fog like mist. Although this is desirable to insure flame stability and to minimize the amount of excess oxygen required for burning the fuel while avoiding emission of visible smoke, it has been shown that intense atomization of a liquid fuel to a fog like mist enhances NOx formation. It has also been discovered that quenching of the burner flame at an optimum location maximizes the amount of NOx reduction that can be achieved by a diluent gas.

The method of the present invention permits controlled atomization of a liquid fuel and/or controlled quenching of a flame zone. By controlling atomization of a liquid fuel, it is possible to suppress NOx emissions without sacrificing flame stability and without increasing the amount of excess combustion oxygen required to avoid smoke. Controlled quenching of the flame zone is important because as the temperature of the burner flame is reduced at the optimum location, the level of NOx emissions also is reduced. The method of the invention advantageously can be practiced by the burner tip of the invention.

As used herein, the terms listed below are defined as follows:

The term "atomization" means reduction to a smaller size, such as reducing large fuel droplets into a fine spray or reducing a fine spray into a fog like mist.

The term "axial" when referring to a direction of introduction relates to a direction which is substantially parallel with the longitudinal axis of a burner tip. The term "radial" when referring to a direction of introduction relates to a direction which is substantially perpendicular to the longitudinal axis of a burner tip.

The "distance" between ports refers to the center-to-center distance.

The terms "flame" and "flame zone" refer to the portion of the combustion zone in which combustion of the fuel is visible.

The term "combustion zone" means a region in which fuel is oxidized.

The term "intersect" means two material (gas and/or liquid) streams contacting each other or a material stream reaching a flame zone.

"Gas port" refers to a location along the length of a burner tip where control gas is discharged from the burner tip.

"Fuel port" refers to a location along the length of a burner tip where fuel is discharged from the burner tip.

Figure 1:
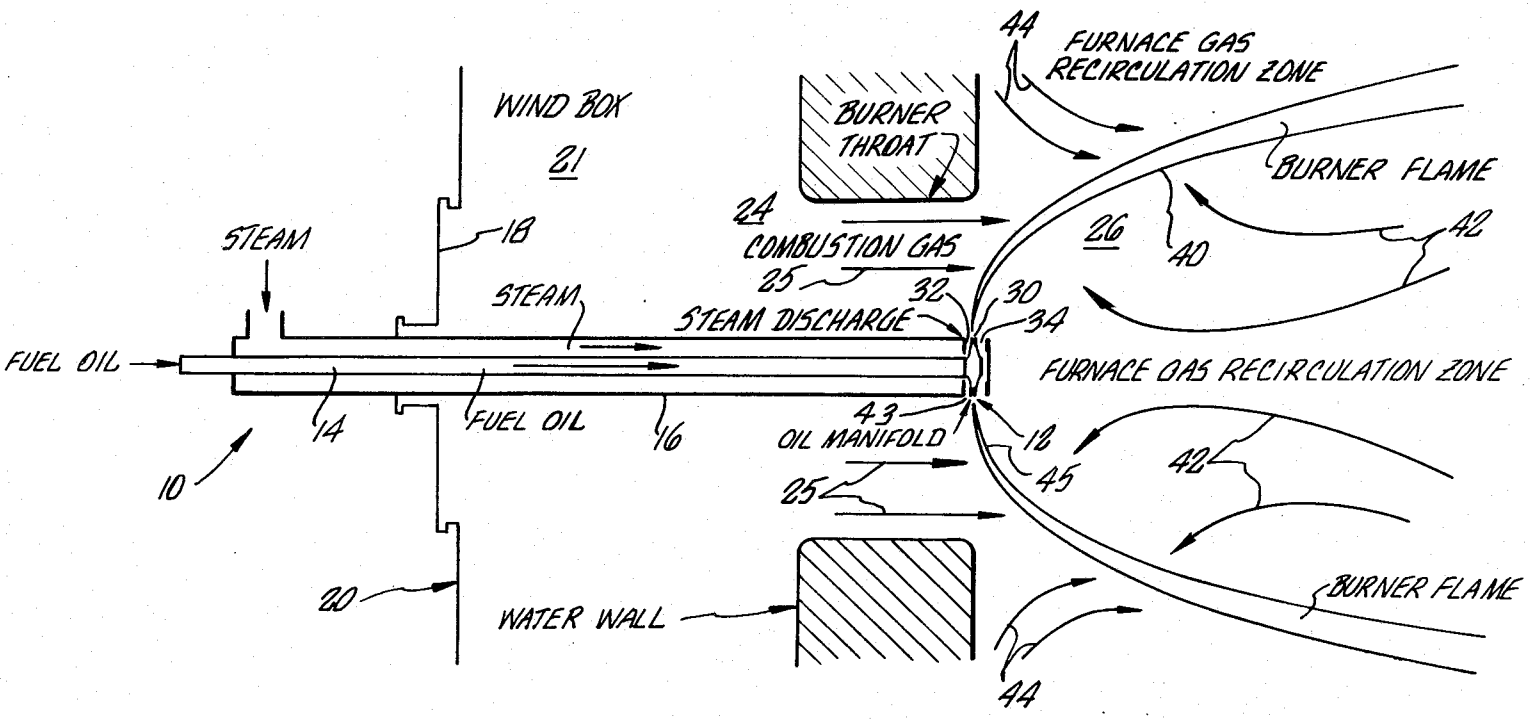

FIG. 1 schematically shows a burner assembly 10 including a burner tip assembly 12 according to the present invention. The burner assembly consists of two concentric pipes, an inner pipe 14 and an outer pipe 16 for delivery of fuel, such as fuel oil, and control gas, such as steam, respectively, to the burner tip assembly 12. The pipes extend through the wall 18 of a boiler 20, through the wind box enclosure 21 of the boiler 20 into the burner throat 24. Combustion gas, represented by arrows 25, is introduced axially into the boiler furnace 26 such that the combustion gas surrounds the burner assembly. Fuel is ejected from the burner tip assembly 12 through a fuel port or oil manifold 30 radially into the combustion gas. In addition, control gas is introduced into the combustion gas radially through gas ports 32 and 34, one located on either side of the fuel port. The control gas, which is injected at a higher velocity than the fuel, accelerates the fuel and atomizes it. The characteristics of the atomized fuel can be varied as set forth in detail below. Atomization need not occur from direct contact between the fuel and the control gas, but can result from turbulent gas flow in the combustion zone caused by the introduction of the control gas.

The dynamic interaction between the radially accelerated fuel and axially flowing combustion air establishes a thin, umbrella-shaped flame profile 40. Due to the interaction of the fuel and control gas with the axial flow of combustion air, two extensive furnace gas recirculation fields are formed. These recirculation fields contribute to the flame stabilization and add to the NOx reduction. One of these recirculation fields is at the core of the umbrella-shaped flame, as shown by arrows 42 in FIG. 1. The discharge of control gas through a continuous slot 43 in the burner tip assembly 12 establishes a negative pressure zone within the core of the burner flame which maximizes furnace gas recirculation into the core of the burner flame. The recirculation of this furnace gas into the core is important, because it serves to quench the flame zone, acting as a diluent. Also, it preheats the fuel to enhance its vaporization and burning in the flame zone, thereby improving the flame stability and the overall combustion efficiency of the furnace for which the burner tip is used. The other recirculation field is formed external to the burner flame at the discharge of combustion air into the furnace, as shown by arrows 44 in FIG. 1. This recirculation field introduces relatively cool combustion products adjacent to the boiler furnace cooler walls into the flame to further reduce flame temperature.

This umbrella-shaped flame front is desirable for suppression of NOx formation because it provides the following features for control of NOx:

1. The umbrella-shaped burner flame establishes a large flame surface area which reduces the heat release rate per unit volume of the flame structure. The flame exposure to the furnace walls enhances radiant dissipation of heat to the walls which reduces the flame temperature.

2. Because the flame thickness is small, the residence time of molecular nitrogen and oxygen in the high temperature flame zone is minimal. This inhibits thermal NOx formation.

3. A negative pressure zone exists within the core of the flame. This results in transfer of combustion products generated under fuel rich stoichiometry to the upstream side 45 of the flame. Reaction of these combustion species within the burner flame results in the partial gas phase reduction of NOx produced in the upstream side 45 of the combustion zone to molecular nitrogen.

4. By virtue of the flame geometry, products of combustion generated in the combustion zone under lean fuel stoichiometry also are processed in the fuel rich core of the flame which again results in a gas phase reduction of NOx to molecular nitrogen.

Although gas phase reduction of NOx to molecular nitrogen is enhanced with an umbrella-shaped burner flame, the primary mechanism for NOx control is the moderation of the level of mixing within the burner flame and the controlled quenching of the flame. Moderating the mixing between combustion air and fuel reduces the portion of the fuel which burns in the hottest portion of the flame zone which produces thermal NOx. Moderating the mixing also reduces the conversion of fuel bound nitrogen to NOx as a result of minimizing the fraction of the fuel burned under locally lean fuel stoichiometry. The injection of the control gas to intercept the flame at the hottest portion of the flame is another important contributor to NOx reduction.

In the following sections, there will be presented the details of the burner assembly (Section II); a variety of burner tip configurations according to the present invention (Section III); operation of the burner tip (Section IV); burner tip design (Section V); Examples (Section VI); and advantages of the burner tip of the present invention and method of its use (Section VII).

II. BURNER ASSEMBLY

Figure 2:
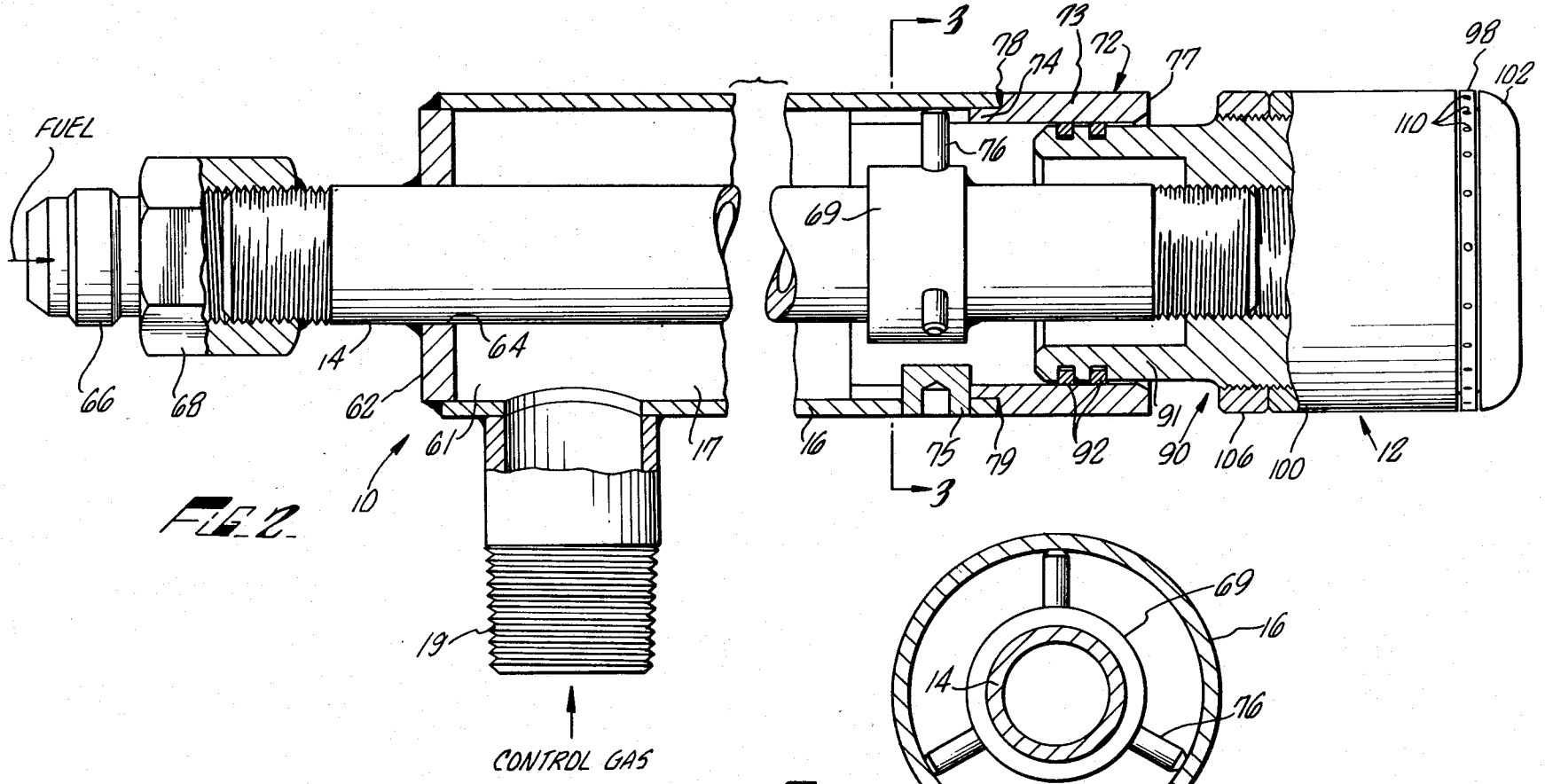
FIG. 2 shows a partial section of a burner gun having a burner tip according to the present invention.

With reference to FIG. 2, a burner assembly 10 is shown as being comprised of the two concentric tubes 14 and 16 with an annular passage 17 therebetween. The inner tube 14 is for fuel and the annular passage 17 is for control gas. A tee threaded nipple 19 connects the outer tube 16 to a control gas source. The end 61 of the outer tube that is opposite the burner tip 12 is sealed shut with a plate 62 having a hole 64 through its middle. The inner tube 14 extends through the hole 64 and is provided at its end with a male coupling 66 equipped with a nut 68 for connection to a flex hose or the like to provide fuel into the inner tube 14. A three-legged spider guide assembly 69, shown in detail in FIG. 3, holds the fuel pipe 14 concentric to the control gas tube 16. The three-legged spider guide is fixed to the outside of the inner tube 14 proximate to the burner tip assembly 12.

Preferably at least the front portion of the inner tube 16 i.e. the furnace side portion, is manufactured from carbon steel material rather than stainless steel to equalize the temperature distribution within the cross section of the tube and thereby avoid distortion and warpage.

To insure a precision seal between the burner tip assembly 12 and the supply tubes 14 and 16, a sealing ring 72 is provided at the end of the outer tube 16. The sealing ring 72 has a first section 74 that fits into the interior of the outer tube 16 and seats up against internal bosses 75 on the inner wall of the outer tube 16; two bosses 75 are provided between the legs 76 of the spider. The sealing ring also comprises a second section 73 that extends outside of the outer tube 16. The sealing ring has a constant internal diameter and an external step 78 separating the first and second sections. The end 79 of the outer tube is welded against the step 78.

III BURNER TIP ASSEMBLY

Figure 4:
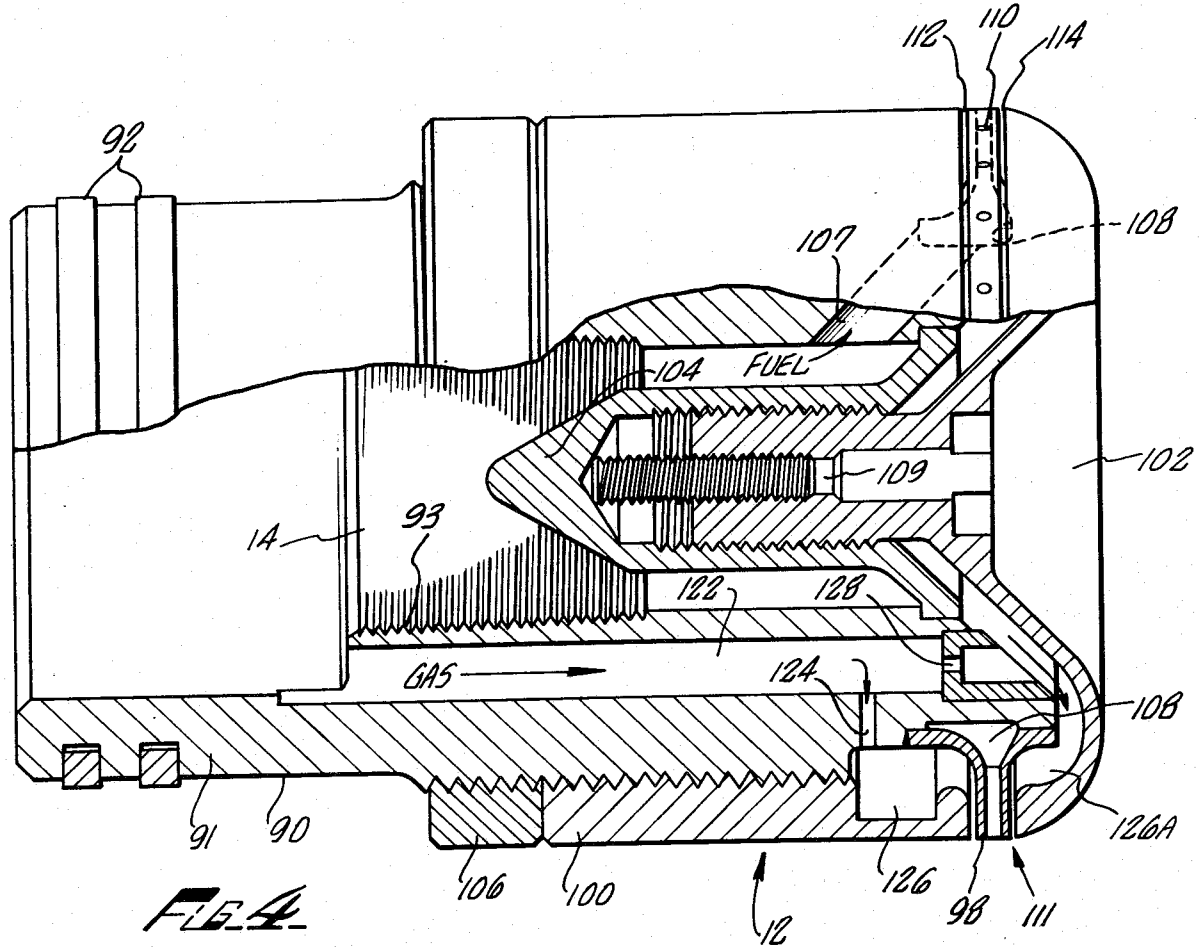
FIG. 4 shows the detail in section of the burner tip of the burner gun of FIG. 2.

The burner tip assembly 12, shown in detail in FIG. 4, comprises a main body portion 90 that includes a tubular extension 91, a fuel ring 98, a steam ring 100, an end cap 102, and a female threaded socket 104. The tubular extension 91 is slideably mounted within the sealing ring 72. Two spaced apart metal piston rings 92 are on the external surface of the tubular extension 91 of the main body 90 for controlling steam leakage between the outer tube 16 and the burner tip assembly 12. The interior of the main body is provided with a female pipe thread 93, into which is threaded the end of the inner tube 14. By sliding the burner tip assembly within the sealing ring 72 and threading the burner tip assembly along the inner tube, axial displacement of the burner tip assembly and the inner tube 14 relative to the remainder of the burner assembly, thus can be obtained. Preferably the outside surface of the tubular extension 91 is chrome plated to prevent galling with the sealing ring 72.

The steam ring 100 is threaded onto the exterior of the main body 90 up against a locking ring 106, which also is threaded onto the outside of the main body 90. The socket 104 is mounted in the interior of the main body and welded in place. The end cap 102 is threaded into the threaded socket 104 and is secured in place by means of a right hand threaded screw 109. The circumferential portions of the end cap 102 and the steam ring 100 are spaced apart from each other and define a gap 111 in which the fuel ring 98 is located. The fuel ring 98 is welded to the exterior of the main body between the steam ring 100 and the end cap 102 in the gap 111.

Fuel from the inner tube 14 flows around the socket 104, through the wall of the main body via a plurality of fuel passages 107 into an oil distribution chamber or manifold 108 directly radially inward from the fuel ring. The manifold 108 introduces the fuel to the fuel ring 98. The fuel ring 98 has a plurality of fuel orifices 110 in fluid communication with the distribution manifold 108. Fuel is passed through these fuel orifices 110 into the combustion chamber.

Between the fuel ring 98 and the steam ring 100 is an inner control gas slot or gap 112 (inner meaning closer to the wind box). Between the fuel ring 98 and the end cap 102 is an outer control gas slot or gap 114 (outer meaning further away from the wind box). These two slots 112 and 114 are used for ejecting steam or other control gas from the burner tip assembly into the combustion chamber. Control gas reaches these two circumferential slots via a plurality of axial control gas passages 122 through the main body. These passages connect to the inner slot 112 by means of first gas metering orifices 124 and a first gas distribution manifold 126 adjacent the first slot. The control gas passages 122 connect to the outer slot 114 by means of second metering orifices 128 and a second gas distribution manifold 126A. The second gas distribution manifold 126A comprises a void between the main body portion 90 and the end cap 102. Thus, the fuel orifices 98 used for ejecting fuel from the burner tip are sandwiched in between slots 112 and 114 used for introducing control gas radially from the burner tip assembly into the combustion zone. The metering orifices 124 and 128 serve to throttle the control gas. Other throttling techniques can be used.

As shown in FIGS. 2 and 4, the fuel and control gas are introduced into the combustion chamber independently, and substantially perpendicular to the direction of introduction of combustion gas. By substantially perpendicular, there is meant an amount ±30° from being exactly perpendicular to the direction of introduction of the combustion gas. Preferably the angle of introduction is perpendicular to the direction of introduction of the combustion gas for both the fuel and control gas.

The fuel orifices 110 in the burner tip shown in FIG. 4 are equally distributed in a single plane around the diameter of the tip. The fuel ring 98, the steam ring 100 and the portion of the end cap 102 adjacent the fuel ring 98 have the same outer diameter. Thus the points of fuel and control gas ejection, i.e. the oil orifices 110 and the steam slots 112 and 114, are at the same radial distance from the tip centerline.

The widths of the control gas ejection slots can easily be changed. The width of the inner slot 112 is varied by moving the steam ring 100 along the threaded outer portion of the body 90. The locking ring 106 serves to prevent a change of dimension of the slot during usage of the burner tip. The width of the outer slot 114 is varied by changing the position of the end cap 102 using the set screw 110.

A spacer ring can be installed between the oil ring 98 and the steam ring 100 to move the inner slot 112 away from the oil ring or to add an additional steam slot on the wind box side. Similarly, a spacer ring can be added in between the oil ring 98 and the end cap 102, either to space the outer slot 114 away from the oil ring 98 or to add an additional steam slot on the side of the steam ring away from the wind box (furnace side).

Hereinbelow, the control gas is generally referred to as being steam, since steam is believed to be the most economical and readily available control gas. However, it should be realized, as discussed in detail below, gases other than steam can be used as the control gas.

Figure 3:
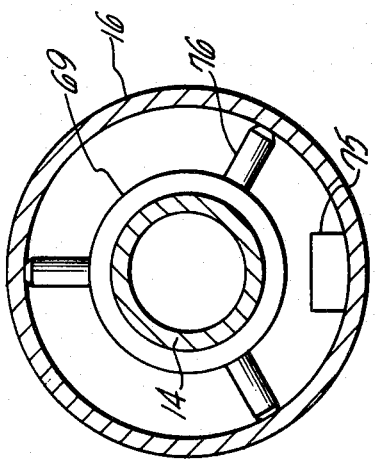
FIG. 3 is a view taken along line 3—3 in FIG. 2, showing a centering device for the burner tip.

According to the method of the present invention as practiced with the burner tip assembly shown in FIGS. 2–4, atomization of the fuel can be controlled to minimize NOx emissions. This can be effected by varying the width of the slots 112 and 114, the pressure of the steam, the number, size, and shape of the fuel orifices, the proximity of the steam slots to the oil ring, the number and shape of the steam slots, and other parameters as described below. This is in contrast to prior art burner tips where fuel and atomization gas are introduced together into a combustion chamber through the same orifice, with little, if any, control of the degree and location of atomization.

A fuel port can comprise a single circumferential slot, more than one slot circumferentially spaced apart from each other around the fuel tip, and preferably, a plurality of orifices circumferentially spaced apart around the burner tip in a plane perpendicular to the longitudinal axis of the burner tip.

A gas port preferably comprises a single slot circumferentially around the burner tip in a plane perpendicular to the longitudinal axis of the burner tip, although it can comprise a plurality of slots longitudinally spaced apart from each other, a plurality of holes or orifices circumferentially spaced apart from each other located in planes longidutinally spaced apart from each other, or the like.

FIG. 5 schematically presents a burner tip according to the present invention, which has a single oil ejection port 150. Spaced on either side of the oil ejection port 150 are two steam slots 152. The steam slots are numbered in FIG. 5, starting at the wind box, as steam slots 1, 2, 3, and 4. The space between steam slot 1 and steam slot 2 is labeled space 1; the space between steam slot 2 and the oil ejection port is identified as space 2; the space between the oil ejection port and steam slot 3 is labeled space 3; and the space between steam slots 3 and 4 is identified as space 4.

Steam is provided from a steam supply 154 through a valve 156 and through a first set of flow control orifices 158 to steam slots 1 and 2. Steam is provided to steam slots 3 and 4 through a second set of flow control orifices 160. A steam pressure gauge 162 is used to monitor the steam supply pressure.

Fuel oil is provided from an oil supply 172, the pressure of which is monitored with a pressure indicator 174. The oil can be passed through an orifice 176 to the burner tip to control the oil pressure. The oil supply pressure to the oil port 150 is monitored with another pressure indicator 178.

Preferred burner tips according to the present invention are schematically shown in FIGS. 6A and 6B. The burner tip 200 shown in FIG. 6A comprises a single fuel port 202 and three gas ports 204, 206, 208. Each of a pair of the gas ports 204, 206 is on either side of the fuel port, with the fuel port sandwiched therebetween. The third gas port 208 is farther away from where the combustion gas is introduced than is the fuel port and the other two gas ports, i.e., the third gas port is on the downstream side of the burner tip and is closest to the end of the burner tip. The third gas port 208 preferably is spaced apart from the fuel port by at least about 0.5 inch. With the burner tip of FIG. 6A, atomization of the fuel is principally effected with control gas introduced through the gas ports 204 and 206 on either side of the fuel port 202. Control gas introduced through the third gas port 208 principally serves to locally quench the flame zone, although it can contribute to atomization of the fuel. In general, the control gas ports 204 and 206 are used at part load operation where improved atomization of the fuel is required. At full load operation, only control gas port 208 is used to provide controlled atomization and localized quenching of the flame for NOx control.

All the ports of the burner tip of FIG. 6A are oriented so as to discharge control gas and fuel into the combustion gas in a direction substantially perpendicular to the direction of introduction of the combustion gas. Control gas introduced through the first two gas ports 204 and 206 generally is introduced at a sufficient rate and a sufficient velocity for atomizing the fuel. The control gas introduced from the third gas port 208 is introduced for localized quenching of the flame zone. This is effected by introducing the control gas so that it intercepts the hottest portion of the flame zone where NOx formation occurs. This maximizes the effectiveness of the quenching operation. Since the hottest portion of the flame is generally the portion of the flame closest to where the combustion gas is introduced, preferably control gas used for localized quenching is introduced into the combustion zone to intersect that portion of the flame.

The burner tip 220 shown in FIG. 6B has two fuel ports, a first fuel port 222 closer to the wind box and a second fuel port 224 farther from the wind box. The use of two fuel ports results in two flames in the combustion chamber. The first fuel port 222 is between two gas ports 226 which provide control gas for atomizing a liquid fuel introduced through the first fuel port 222. Likewise, the second fuel port 224 is between two gas ports 228 which atomize a liquid fuel introduced through the second fuel port 224. A third gas port 230 is provided for the second fuel port 224, the third gas port being near the end 232 of the burner tip 220, and principally serving to provide control gas for controlled localized quenching of the flame zone established by the second fuel port 224.

The fuel introduced through the first and second fuel ports can be the same or different. Likewise, the control gas used for the five different gas ports can be the same or different, although typically, the same control gas is used for all gas ports. When different fuels are used, a concentric passage is provided through the burner gun assembly for each type of fuel.

Other burner tips for practicing the method of the present invention are shown in FIGS. 7A–7C. In each of these burner tips, each fuel port 233 is coaligned with a gas port 234. Although ejection of a liquid fuel from an orifice, even without an atomization gas, inherently results in some degree of atomization of the the fuel, in the versions of the present invention shown in FIGS. 7A–7C; a greater degree of atomization occurs due to the presence of gas provided through gas ports 234. However, each burner tip shown in FIGS. 7A–7C has at least one separate gas port 235 which is not coaligned with a fuel port. These independent gas ports can be used for independently introducing control gas into a combustion zone for controlling the degree of atomization of the fuel and for controlled localized quenching of the flame zone. Although the degree of control obtainable with the versions of the present invention as shown in FIGS. 7A–7C is not the same as the degree of control obtainable with the burner tips of FIGS. 4,5, 6A and 6B, independent control of atomization and quenching can be obtained. It is this independent control which distinguishes the burner tips of FIGS. 7A–7C from what was available in the prior art. It is this independent control that allows suppression of NOx emissions from combustion of fuel without adversely affecting flame stability and combustion efficiency.

FIGS. 8–10 show a dual tip burner configuration 600 according to the present invention. The main components of the burner configuration 600 are a front burner tip assembly 602, shown in detail in FIG. 10, a rear burner tip assembly 604, shown in detail in FIG. 9, a front manifold assembly 606, and a rear manifold assembly 608. The dual tip burner 600 comprises four concentric tubes, an innermost tube 610, a next innermost tube 611, an outermost tube 613, and a next outermost tube 612. The innermost tube 610 extends along substantially the entire length of the burner assembly 600. The two outer tubes 612 and 613 originate in the front manifold assembly 606.

In use, the innermost tube carries oil for the front burner tip assembly 602, steam is carried in the annular space beween tubes 610 and 611 for the front burner tip assembly, oil is carried in the annular space between tubes 611 and 612 for the rear burner tip assembly 604, and steam is carried in the annular space between tubes 612 and 613 for the rear burner tip assembly 604.

The tubes 610 and 611 originate at the rear manifold assembly 608. The rear manifold assembly 608 comprises a collar 616 having an internally stepped configuration. The smallest internal diameter of the collar 616 is such that the innermost tube 610 fits snuggly therein. The largest internal diameter of the collar 616 is such that the next innermost tube 611 fits snuggly therein. O-rings 618 are placed between the collar and the innermost tube 610 and an O-ring 620 is placed between the collar and the tube 611 to prevent fluid leakage.

The innermost tube 610 extends to the rear of the rear manifold assembly 608 where it is met by an axially oriented oil supply tube 622. A radially oriented steam supply tube 624 projects from the collar 616 and is used for supplying steam into the annular region between tubes 610 and 611.

The front manifold assembly 606, like the rear manifold assembly 604, comprises a collar 630 having a stepped interior. The interior of the collar 630 is stepped so that it can fit snuggly over tubes 611, 612, and 613, with O-rings 629, 631 and 633 disposed between the collar and the exterior of each of the tubes 611, 612, and 613, respectively, to prevent fluid leakage.

The collar 630 is provided with two radially oriented supply pipes 632 and 634, the rearward pipe 632 being used for supplying oil to the annular region between tubes 611 and 612 and the forward pipe 634 being used for supplying steam to the annular region between tubes 612 and 613.

The rear and front manifold assemblies are maintained rigidly spaced apart by means of three axially oriented rods 636 secured to the collars. The rods 636 extend through a radially projecting flange 638 of the collar 616 of the rear manifold assembly 608 so that the spacing between the two manifold assemblies can be varied as required.

The innermost tube 610 and the next innermost tube 611 extend through the rear burner tip assembly 604 up through the front burner tip assembly. The next outermost tube 612 and the outermost tube 613 terminate at the rear of burner tip assembly 604.

With reference to FIG. 9, the rear burner tip assembly 604 comprises a mounting ring 642, an orifice ring 644, and an end ring 646. The orifice ring is between the mounting ring and the end ring. The mounting ring 642 is welded to the end of the outermost tube 613 and the orifice ring 644 is welded to the end of the next outermost tube 612. The end ring 646, mounting ring 642, and orifice ring 644 are held together by three axially-oriented screws 668. Tubular spacers 650 are placed around the screws 668 between the end ring and the orifice ring, and between the orifice ring and the mounting ring for maintaining these elements spaced apart, thereby forming a gap or slot 652 between the orifice ring 644 and the mounting ring 642 and a gap or slot 654 between the orifice ring 644 and the end ring 646. The gaps 652 and 654 are used for ejecting steam into a combustion zone. The size of these gaps is determined by the length of the spacers 650. Steam reaches the slot 652 directly from the annular region between tubes 612 and 613. Steam reaches the slot 654 by passing through a plurality of axially-oriented passages (not shown) through the orifice ring 644.

The orifice ring 644 has a plurality of fuel orifices 656 in communication with the annular region between the tubes 612 and 613. The fuel orifices 656 are equally distributed in a single plane around the diameter of the rear burner tip assembly 604. The orifice ring 644, the mounting ring 642 and the end ring 646 are of the same outer diameter. Thus the points of oil and steam ejection, i.e., the oil orifices 656 and the steam slots 652 and 654, are at the same radial distance from the center line of the burner.

The front burner tip assembly 602 includes a flange 660, an orifice ring 662, a plug 664, and an end cap 666. The flange 660 is welded to the end of the tube 611 and the orifice ring 662 is welded to the end of the innermost tube 610. The end cap 666, which has a hemispherical central portion 668, is attached with three threaded axially-oriented tie rods 670 to the flange 660 and the orifice ring 662, with the orifice ring 662 between the flange 660 and the end cap 666. Spacers 671 are placed around the rods 670 between the flange and the orifice ring and between the cap and the orifice ring to form gaps 672 and 674, respectively, therebetween. The size of the gaps 672 and 674 can be varied by changing the length of the spacers 671 around the rods 670. The plug 664 is threaded into an axially-extending flange portion 678 of the orifice ring 662, with an O-ring 679 mounted therebetween to prevent fluid leakage.

The plug 664 and the orifice ring 662 cooperate to form a spherical chamber 682 in communication with the innermost tube 610. Oil passes from the tube 610 into this chamber 682 and from the chamber to a plurality of orifices 684 in communication therewith, the orifices being on the outer surface of the orifice ring 662. The orifices are equally distributed in a single plane around the diameter of the front burner tip assembly 602.

Steam passes from the annular region between tubes 610 and 611 to the gap 672 between the flange 660 and the orifice ring 644 for introduction into a combustion zone. A portion of the steam passes through axial passages (not shown) through the orifice ring 662 to the gap 674 between the orifice ring 662 and the cap 668 for introduction into the combustion zone.

The flange 660, the orifice ring 662, and the end cap 666 are of the same diameter. Thus the points of oil and steam ejection, i.e., the oil orifices 684 and the steam slots or gaps 672 and 674, are of the same radial distance from the burner center line.

The three axially-oriented tie rods 670 extend from the front burner tip assembly 602 to the rear burner tip assembly 604. The front burner tip assembly can be axially moved along these rods 670 to vary the spacing between the front and rear burner tip assemblies.

Also provided are rods 700 (FIG. 8) extending through a flange 702 on the exterior surface of the collar 630 of the front manifold assembly. The purpose of these rods 700 is to mount the burner rod to a furnace.

IV. OPERATION OF THE BURNER TIP

In this section the method of the invention as employed in the operation of a burner tip according to the invention is described.

The combustion gas used with the burner tip can be any oxygen containing gas. Typically it is air, but it can be air enriched with oxygen, or air containing an inert diluent such as recycled flue gas.

The control gas used with the burner tip can be steam, flue gas, nitrogen or other non-reactive gas, fuel such as natural gas or synthetic gas, an oxygen containing gas, and mixtures thereof. The preferred control gas is steam because ordinarily steam is readily available at a utility boiler furnace. Steam consumption for a furnace using six burners according to the present invention, each burner rated at 85,000,000 BTUs per hour, was in the order of 0.05 pounds or less of steam per pound of fuel oil consumed.

The fuel used can be gaseous or liquid, although with gaseous fuels, atomization generally is not required. As used herein, the terms "gaseous" and "liquid" refer to the physical state of the fuel at the temperature at which it is discharged from the burner tip. A gaseous fuel can be a fuel such as natural or synthetic gas. Liquid fuels which can be used with the burner tip include fuel oil and other petroleum based oils; synthetic oils, including high nitrogen content oils derived from oil shale and coal; and combinations thereof.

The burner tip configuration of FIG. 6B can advantageously be used with a fuel of relatively high nitrogen content. The fuel of relatively high nitrogen content is introduced into a combustion zone through the second fuel port 224, while a fuel of relatively lower nitrogen content, which can contain substantially no nitrogen, is introduced into the combustion zone from the first fuel port 222. By doing this, the fuel of higher nitrogen content is burned in a lower concentration of oxygen than is the fuel of lower nitrogen content, because a portion of the oxygen in the combustion gas is consumed in the burning of the fuel of lower nitrogen content. Because the fuel of higher nitrogen content is burned in a relatively low oxygen environment, less NOx from oxidation of organically bound fuel nitrogen is formed.

At full burner load when a liquid fuel is ejected from a burner tip, its interaction with combustion air results in secondary atomization of the fuel even when only a single control gas port is used at a displaced distance away from the fuel port. At part loads, however, the fuel injection and combustion air velocities are reduced which minimizes the effect of this secondary atomization. Therefore, in order to ensure good burner performance at part burner load, the atomization of the fuel must be provided by the control gas. The burner configurations shown in FIGS. 6A and 6B represent an arrangement for the use of the control gas to improve the atomization of fuel. It should be noted that in all cases, a gas port that is positioned at a distance from the oil port must be used to provide for local flame quenching and NOx reduction.

The burner tip of the present invention can be used in many different types of applications. It can be used for large scale and small scale furnaces. It can be retrofitted onto existing installations. It can successfully be operated at full capacity, at high turn down ratios of 5:1, and can be used with installations requiring one or more burners. The burner tip can be oriented horizontally, or it can be oriented at an angle to the horizontal, or it can be oriented vertically. In such a vertical orientation, the fuel and control gas are introduced horizontally into a combustion chamber.

V. BURNER TIP DESIGN

The burner tip of the present invention is a means to provide the operator of a combustion device with the necessary compromise between competing considerations. For example, it has been established during the development of the burner tip that the increase of fuel atomization increases fuel-bound nitrogen conversion to NOx and increases flame temperature resulting in an increase in thermal NOx formation. Therefore, it is desirable to control atomization of the fuel. Conversely, inadequate atomization of the fuel can cause flame instability and inefficient utilization of the fuel. As the amount of excess oxygen provided for the burning of the fuel is increased to combat flame instability and to avoid visible smoke emissions, formation of NOx increases. In short, either too much or not enough atomization can result in excessively high levels of NOx emissions.

These and other competing considerations can be reconciled by the present invention which provides for independent control of the atomization and quenching gases in order to optimize atomization and quenching for minimum NOx emissions in a particular system. According to the invention, the following parameters of a burner tip can be varied as desired:

A. Number of Fuel Ports

One or more fuel ports can be used. While data to date indicate that the number of fuel ports does not by itself affect the level of NOx emissions, by using dual ports both a gaseous fuel and a liquid fuel can be burned simultaneously. This is effected by burning the gaseous fuel, which for non-synthetic fuels typically has low nitrogen content, in a fuel lean environment by introducing it from the fuel port closest to the wind box. The liquid fuel, which typically has a higher nitrogen content than a gaseous fuel, is burned in a fuel rich environment by being introduced into the combustion zone from the fuel port farthest away from the wind box. Because the fuel rich environment farther from the wind box tends to suppress NOx formation, this configuration helps minimize NOx emissions from burning of the liquid fuel. The two fuel ports are spaced apart a sufficient amount that each produces a separate, independent flame.

This is analogous to burning a relatively high nitrogen content fuel and a relatively low nitrogen content fuel, as discussed above, where the relatively high nitrogen content fuel is introduced from the fuel port farther away from the wind box, so that it can be burned in a low oxygen environment.

The number of fuel ports can be increased to increase the rating of a burner without increasing its diameter.

B. Shape of the Fuel Port

The fuel ports can have the same or different shape. Each fuel port can be a continuous slot, or preferably a plurality of orifices circumferentially spaced apart around the burner tip in the same plane perpendicular to the longitudinal axis of the burner tip. A slot is advantageous with gas or other fuel where controlled atomization is not required, because a high fuel rating for a burner tip can be achieved while ejecting the fuel into the combustion zone with a sufficiently low velocity so that fuel impingement on the furnace walls does not occur.

C. Size of the Fuel Orifices

The size of the fuel orifices affects the degree of atomization achieved, which in turn, as discussed above, affects both flame stability and level of NOx emissions. As the orifice diameter increases, atomization of the fuel decreases. Conversely, as orifice diameter decreases, atomization of fuel increases. A too large or too small diameter is undesirable because NOx emissions increase.

A too large orifice diameter produces coarse fuel atomization which leads to flame instability, inefficient combustion and the production of smoke. To suppress smoke emission, excess $O_2$ within the furnace must be increased to very high levels which in turn leads to an increase in thermal NOx formation (high concentration of excess oxygen available in the furnace) and increased conversion of organically bound fuel nitrogen to NOx. As a result, coarse fuel atomization does not provide the required NOx reduction, but instead results in an increase in NOx emission. Fine atomization of the fuel on the other hand, enhances mixing intensity between the fuel and combustion air and results in high NOx production. Thus, too large or too small oil orifices are undesirable because they both can result in an increase in NOx emissions.

For liquid fuels, an orifice diameter much below 0.01 inch is undesirable because there is a tendency to plug the orifices. Orifice diameters above 0.1 inch are generally undesirable because of a tendency to produce very coarse fuel atomization. Therefore, the orifice diameter is from about 0.01 to about 0.1 inch. To be sure to avoid plugging and to obtain the desired control over the degree of fuel atomization, preferably the orifice diameter is from about 0.03 to about 0.07 inch, and more preferably about 0.05 inch.

All of the oil orifices do not need to be the same size. For example, some relatively small diameter orifices can be used to insure sufficient atomization for a stable flame and good combustion efficiency. In the same burner tip, some relatively large diameter orifices can be used to achieve less atomization for suppression of NOx emissions. For a burner tip having orifices of different diameters, the difference between the larger and smaller orifices is at least about 0.01 inch, but is not more than about 0.05 inch.

D. Fuel Pressure and Fuel Port Surface Area

For a burner of a specific BTU rating, the fuel feed pressure at which a burner can successfully be operated, at full load, depends upon the size and number of fuel orifices used (port surface area). By varying the fuel feed pressure, the velocity momentum of the fuel is varried. As the fuel feed pressure is increased, the fuel penetrates deeper into the combustion air and an improvement in the level of fuel atomization is attained. However, too much atomization can result in an increase in NOx emissions. Furthermore, it is believed that when the fuel injection pressure exceeds a certain maximum (determined by fuel orifice diameter, fuel momentum, burner throat diameter and combustion gas flow velocity) the fuel penetrates through the combustion gas without significant atomization. This leads to fuel impingement on the walls of the furnace and inefficient mixing between the combustion air and fuel, resulting in smoke emission. In addition, increasing the oil pressure and the injection velocity of the fuel reduces the differential momentum between the fuel and the control gas, which can reduce the control gas effectiveness in atomizing the fuel and result in flame instability. Increasing the excess $O_2$ to overcome these problems can lead to high NOx emissions.

The maximum injection velocity and in turn burner fuel feed pressure that can be used in a specific application are dependent upon: (1) the fuel orifice diameter, (2) combustion air flow velocity at its discharge into the furnace, (3) fuel monentum, and (4) the burner throat diameter. In general higher burner pressure (injection velocities) can be used with small fuel orifices due to the ease of atomizing small diameter fuel jets. High burner pressure can be also used when combustion gas flow velocity is high and when the diameter of the burner throat is sufficiently large to prevent fuel penetration through the combustion gas.

Limiting the burner fuel pressure to a low value at full load can adversely affect the fuel atomization and in turn the interaction between the combustion air and fuel, which can lead to high NOx production. Limiting the burner fuel supply pressure at full load to a low value limits the effective turn down capability of the burner for part load operation.

E. Angle of Ejection of Fuel

The fuel is ejected from the burner tip substantially perpendicular (±30° from exactly perpendicular) to the direction of introduction of the combustion gas into the furnace so that a dynamically stable umbrella-shaped envelope of an air/fuel mixture is produced. The initial ignition of this combustible mixture occurs where the local stoichiometry and temperature within the combustion zone can support the formation of a visible flame. Because of dynamic stabilization of the flame, it is possible to use coarse atomization of the fuel and moderate mixing for maximum NOx reduction, without sacrificing flame stability. The perpendicular injection of the fuel and its interaction with combustion gas along with the introduction of the control gas help establish a furnace gas recirculation zone within the core of the flame which augments flame stabilization by pumping hot gas towards the burner tip for prevaporization and heating of the fuel/air mixture. The circulation of this gas to the burner flame also acts as a diluent to-moderate the flame temperature for added NOx reduction.

Depending on (1) the combustion gas velocity, (2) the fuel injection velocity and momentum, and (3) furnace size, the injection angle of the fuel may be ±30° from being exactly perpendicular to the direction of combustion air flow of the burner flame. This injection angle dictates the flame profile, the flame surface area, and volume, and in turn heat dissipation to the furnace walls. The fuel injection angle also determines the penetration depth of the flame into the furnace and the level of mixing between combustion air and fuel. Selection of the fuel injection angle is application specific in view of its dependence on the geometry of the combustion apparatus. Generally, if the angle of introduction of the fuel is more than 30° away from the perpendicular toward the windbox side, a portion of the fuel can impinge against the furnace wall. If the angle of introduction is more than 30° away from the perpendicular on the furnace side, significant elongation of the flame occurs. This can reduce the flame cone angle and destroy the combustion gas recirculation zone within the core of the flame. It is not necessary that all of the fuel be introduced at the same angle.

F. Orifice Distribution

For ease of fabrication, preferably the oil orifices are equally spaced apart circumferentially around the burner tip. To reduce the burner weight and diameter at high BTU ratings, two or more oil orifices rings may be provided in a single fuel port, where the orifices are arranged in staggered form so that the orifices in the parallel rings are not aligned. More than one fuel port can be used in tandem spaced apart for the use of several fuels of different nitrogen content or for improved NOx control capability.

Number of Control Gas Ports

According to the present invention, there is at least one control gas ejection port that is not aligned with a fuel port. If only a single independent gas port is used, it provides gas for both local controlled quenching of the flame zone and for controlled atomization of a liquid fuel. There can be more than one gas port, so that the quenching and atomization functions can be independent. The number of gas ports used is application specific and generally depends upon burner operating variables such as combustion gas flow velocity, fuel injection velocity and momentum, and furnace size. The best firing configuration at full load for NOx control is with the control gas ports displaced at least 0.3 inch away from the fuel port. To provide good turn down capability of the burner and obtain stable flame at part load operation, two additional control gas ports can be used for each fuel port so that each fuel port is sandwiched in between two gas ports to achieve effective atomization of the fuel when needed. FIGS. 6A and 6B show this arrangement.

Some gas can be introduced directly with the fuel as in prior art devices. This is less desirable though, because this type of "internal" atomization can result in cavitation with an easily atomized fuel. Furthermore, internal atomization does not give the same control of atomization as obtained with the "external" atomization of the present invention. According to the present invention, preferably fuel is introduced as a coherent mass into the combustion zoresent invention. According to the present invention, preferably fuel is introduced as a coherent mass into the combustion zone without any atomization gas.

H. Shape of Gas Ports

For ease of fabrication, preferably the gas ports are a continuous slot as shown in FIG. 3. The entrance to each slot preferably is bell-shaped with a generous radius to guide the control gas for discharge into the furnace with a minimum pressure drop. The width to depth ratio of the discharge slot is from about 10 to 20 to ensure the stability of the control gas jet as it irs ejected into the furnace. Uniform distribution of the control gas within the gas manifold before it is ejected through the port is important. In addition to the continuous slot configuration, other ports configuratd before it is ejected through the port is important. In addition to the continuous slot configuration, other ports configuration with round and/or rectangular-shaped orifices can be used.

I. Control Gas Momentum

The momentum of the control gas is an important variable in design and operation of the burner tip of the present invention. The momentum of the control gas is a product of its mass and velocity, and is controlled by the size of the gas ports and the control gas supply pressure. The velocity of the control gas is greater than the velocity of the fuel to achieve atomization of the fuel. If the momentum of the control gas is too high, too much atomization and too high a level of NOx emissions results. On the other hand, low momentum results in inadequate atomization, which can result in an unstable flame and the need for excessive quantities of combustion gas, which can result in an increase in NOx emissions.

The control gas momentum also influences the degree of furnace gas recirculation within the core of the burner flame. High momentum leads to increased furnace gas recirculation and low momentum decreases the level of recirculation.

In addition, the momentum of the control gas determines the location of control gas interception with the flame and therefore the effectiveness of the control gas in locally quenching the flame and reducing NOx production. It is preferred that the control gas intercept the burner flame at the location where visible flame first appear. In this location, combustion is generally fuel lean with fuel oxidation occurring in the form of a diffusion flame which has a very high flame temperature that approximates the adiabatic flame temperature of the fuel. Providing local quenching in this location maximizes the quenching effect of the control gas and results in the maximum reduction of NOx emissions.

Hereinbelow examples of use of the burner tip of the present invention are provided, including data concerning the momentum of the control gas. Once the size and number of the fuel and the control gas ports are fixed during operation of a burner tip, the only process parameter available for changing control gas momentum is the control gas supply pressure. Higher pressures increase momentum and lower presures decrease momentum.

J. Size of Gas Ports

Preferably each gas port slot is at least about 0.01 inch wide to insure sufficient penetration of the control gas into the furnace. Preferably, the width of each gas port slot is no more than about 0.1 inch wide to avoid excessive usage of control gas. For optimum atomization of a liquid fuel, preferably each slot is from about 0.01 to about 0.05 inch wide.

K. Angle of Introduction of Control Gas.

The control gas is introduced substantially perpendicular to the angle of introduction of the combustion gas. When the angle at which the control gas is introduced is tilted toward the wind box, it opens up the umbrella shape of the flame. When the control gas is introduced away from the wind box, it closes or narrows down the core of the flame front.

The angle of introduction of the control gas is an important parameter because it affects fuel atomization, mixing between combustion air and the fuel, and the localized quenching of the flame. All of these parameters affect the level of NOx emissions. When the control gas is introduced into the combustion zone at an angle tilted toward the wind box, the level of fuel atomization and mixing within the flame are enhanced. Also, the quenching of the flame significantly diminishes due to the early mixing of the control gas with combustion air. These factors can lead to an increase in NOx emissions. Tilting the control gas toward the wind box is used for increased mixing between the fuel and the combustion air for enhanced flame stability.

When the control gas is introduced into the combustion zone at an angle tilted away from the wind box, less atomization of the fuel occurs, which tends to reduce NOx emissions. However, the control gas intercepts the downstream side of the flame, which limits the quenching effect of the control gas. In addition, the core of the flame is narrowed down. This reduces the furnace gas recirculation which can lead to flame instability and high NOx value. Introducing the control gas at an angle away from the wind box can prevent fuel deposition on the furnace walls, especially during part load operation.

L. Spacing of Gas Ports from a Fuel Port

The spacing of the control gas ports from the fuel ports has a great effect on NOx emissions. For example, if the gas ports are too far from the fuel ports, inadequate atomization and inadequate quenching can occur. Poor atomization leads, as discussed earlier, to the need to increase the operating level of excess $O_2$ to suppress smoke emissions. More excess $O_2$ results in high NOx production. Inadequate quenching occurs as a result of having the control gas intercept the flame too late during the combustion process. As a result, the quenching effect of the control gas is minimized which ultimately leads to high NOx emmissions.

Conversely, positioning the control gas port too close to the fuel port can increase fuel atomization so much that excessively high NOx emissions result. The control gas can, as a result of being in close proximity to the fuel port, become mixed and dispersed too soon within the combustion gas which significantly minimizes its localized quenching effect.

To reconcile these conflicting effects-and-achieve maximum NOx reduction, it is preferred that the gas port be positioned no further away from a fuel port than about 2 inches. Although it is possible for a gas port to be directly adjacent to a fuel port, for improved atomization, it is preferred that the distance between the gas and the fuel ports be from about 0.3 to about 1.5 inches.

M. General Design Considerations

From the above discussion, general design considerations become apparent. For example, for optimum quenching, the control gas should intersect the flame zone at its hottest portion, which generally is the portion closest to where the combustion gas is introduced. In addition, to minimize atomization of the fuel at full load, preferably the control gas does not intersect the fuel until the fuel reaches the flame, and most preferably intercepts the fuel just as the fuel reaches the flame. Thus, the spacing between the control gas ports and the fuel ports, the size and shape of the ports, the angle of introduction of the fuel and control gas, and the other design and operating parameters of a burner tip are selected to satisfy these design considerations.

VI. EXAMPLES

The features of the present invention will become better understood with reference to the following examples:

Example 1

An evaluation of a burner tip embodying features of the present invention was performed at Unit 4 of the Southern California Edison Highgrove Generating Station. A schematic drawing of the boiler configuration is shown in FIG. 11. The boiler 300 was a balanced draft, 45 MWE Combustion Engineering Boiler, equipped with six front-face mounted oil and gas burners 302, each rated at 85,000,000 BTU per hr. The burner and burner tips used are shown in FIGS. 1–4. A spacer ring was installed between the fuel ring 98 and the steam ring 100 to provide two steam slots on the wind box side. A spacer ring also was installed between the fuel ring 98 and the end cap 102 to provide two steam slots on the furnace side. The outer diameter of the burner tip was 2.5 inches. Representative test data are presented in Table 1.

To enhance NOx control capability of the burners, a special air register 310, shown in FIG. 12, was used for all tests reported in Table 1. The register 310 comprised three concentric annular ducts 312, 314, 316, each with an adjustable damper plate 318 positioned at its inlet. Each damper plate 318 is provided with a control rod 320 extending through the wind box so that the position of the damper plate in the ducts can be varied. The stagnation and velocity pressures in any of the ducts was changed by altering the distance between the damper and the duct inlet. The length to diameter ratio of the ducts was selected so that the distorted combustion air flow field downstream of the dampers was uniform before air entered the burner throat. The dampers are interconnected so that they can all be moved simultaneously, or individually. A uniform velocity profile is achieved when the dampers are equidistant from their annular openings.

It is believed that the air register 310 shown in FIG. 9 was able to eliminate swirl within the combustion air flow field, a known cause for NOx generation, without sacrificing burner stability. The register also maintained a uniform combustion air velocity profile across the burner throat, which diminished peak flow velocities that could intensify mixing, and in turn, NOx generation. Furthermore, the register provided a well-distributed axisymmetric combustion air flow around the burner flame, which is believed to help reduce the smoke limit of the burner. Other apparatus and other methods for eliminating swirl within the combustion zone can be used where needed. For furnaces without a swirl problem, no special air flow profile equipment such as the air register 310 is required.

Most of the testing performed during this program was to identify the effect of fuel atomization on NOx formation. Due to the inherent flexibility of the burner design, the testing of several burner configurations was possible by making only minor adjustments of burner tip hardware. The tested burner configurations were selected to provide substantially different levels of fuel atomization at the same steam consumption so that the effect of atomization on NOx could be isolated from the thermal quenching effect of steam used for atomization. The use of steam control orifices in the burner gun ensured that steam flow was only a function of atomization steam supply pressure and was independent of the tested burner configuration.

The test matrix was initiated by selecting a certain burner configuration and atomization steam pressure. In most cases, the highest atomization steam pressure expected to be used with a specific burner configuration was tested initially. When the unit load reached 42–43 MWE, furnace excess oxygen was slowly reduced by choking the inlet of the boiler's forced draft fan until excess oxygen within the furnace reached the lowest level that could be steadily maintained without visible smoke emission. A sample of flue gas was then taken and analyzed for percent excess oxygen, carbon dioxide, and NOx. The level of excess oxygen measured under these conditions was termed the "smoke limit" or "smoke point". To change atomization pressure to a different level without visible emission, excess oxygen was raised, atomization pressure was changed, and then the new smoke point was established. The NOx emission at the new atomization pressure was then determined. To ensure stable boiler operating conditions after each change, sufficient time was allowed to lapse prior to obtaining flue gas samples. NOx data were generally obtained for each burner firing configuration for at least four discrete steam pressures.

The flue gas composition was measured with industrially acceptable, high-quality emission measurment instrumentation. Capability was provided for sampling the concentration of oxides of nitrogen, carbon monoxide, carbon dioxide, and oxygen. Samples of the flue gas were taken in the flue gas duct in the plane shown by dashed line 320 in FIG. 11. Twelve sampling regions in a rectangular three by four matrix were used. The samples taken were conditioned with respect to temperature, pressure, particulate concentration, and moisture content before emission analysis was conducted. A Chemiluminescent Gas Analyzer was used for NOx measurements, and a Carale Basic Gas Chromatograph was used for measurement of carbon dioxide and oxygen.

In addition to examining the effect of atomization on NOx formation, NOx data were also obtained to determine the effect of boiler excess oxygen level on NOx emissions. The steam pressure that resulted in the lowest NOx emission level for a specific burner configuration was used to determine NOx variation with the level of excess $O_2$.

TABLE 1

| Test | No. of Oil | Oil Orifice | Oil Pressure | Steam Slot Size (in)(3) | | | | Steam Slot Spacing (in) | | | | Boiler Load | Steam Pressure | Smoke(1) Limit | NOx(2) |
|---|---|---|---|---|---|---|---|---|---|---|---|---|---|---|---|
| No. | Orifices | Dia/inch | (PSIG) | 1 | 2 | 3 | 4 | 1 | 2 | 3 | 4 | (MWE) | (PSIG) | (% $O_2$) | (ppm) |
| 63 | 60 | .05 | 20 | x | .02 | .02 | x | — | .05 | .05 | — | 42 | 10 | 6.0 | 188 |
| 64 | 60 | .05 | 20 | x | .05 | .05 | x | — | .05 | .05 | — | 43 | 60 | 5.1 | 166 |
| 65 | 60 | .05 | 19 | .02 | x | x | .02 | 1.2 | .05 | .05 | 1.2 | 42 | 20 | 7.3 | 181 |
| 66 | 60 | .05 | 20 | .05 | x | x | .05 | 1.2 | .05 | .05 | 1.2 | 42 | 60 | 5.7 | 174 |
| 73 | 60 | .05 | 20 | x | x | .01 | x | — | — | .05 | — | 42 | 60 | 6.0 | 184 |
| 81 | 60 | .05 | 20 | x | x | x | .01 | — | — | .05 | 1.2 | 42.5 | 70 | 4.4 | 152 |
| 84 | 60 | .05 | 19 | x | x | x | .01 | — | — | .05 | 1.2 | 43 | 60 | 4.5 | 151 |
| 85 | 60 | .05 | 19 | x | x | x | .01 | — | — | .05 | 1.2 | 42.2 | 60 | 4.6 | 160 |
| 88 | 60 | .05 | 18 | x | x | x | .01 | — | — | .05 | .575 | 42 | 60 | 4.3 | 154 |
| 89 | 60 | .05 | 19 | x | x | x | .01 | — | — | .05 | .575 | 42.5 | 60 | 4.4 | 158 |

TABLE 1-continued

| Test No. | No. of Oil Orifices | Oil Orifice Dia/inch | Oil Pressure (PSIG) | Steam Slot Size (in)(3) 1 | 2 | 3 | 4 | Steam Slot Spacing (in) 1 | 2 | 3 | 4 | Boiler Load (MWE) | Steam Pressure (PSIG) | Smoke(1) Limit (% $O_2$) | NOx(2) (ppm) |
|---|---|---|---|---|---|---|---|---|---|---|---|---|---|---|---|
| 92 | 45 | .05 | 26 | x | x | x | .01 | — | — | .05 | 1.825 | 42.5 | 60 | 4.4 | 154 |
| 94 | 45 | .05 | 26 | x | x | x | .02 | — | — | .05 | 1.2 | 42.5 | 60 | 4.3 | 157 |
| 95 | 60 | .05 | 20 | x | x | x | .01 | — | — | .05 | 1.825 | 43 | 60 | 5.0 | 163 |
| 98 | 60 | .05 | 20 | x | x | x | .01 | — | — | .05 | 1.2 | 42.5 | 60 | 4.4 | 156 |
| 99 | 60 | .05 | 20 | x | x | x | .01 | — | — | .05 | 1.2 | 42.5 | 80 | 4.8 | 157 |
| 100 | 60 | .05 | 22 | x | x | x | .02 | — | — | .05 | 1.2 | 42.2 | 60 | 4.8 | 164 |
| 101 | 60 | .05 | 20 | x | x | x | .01 | — | — | .05 | 1.2 | 42.5 | 60 | 4.3 | 155 |
| 102 | 60 | .05 | 20 | x | x | x | .01 | — | — | .05 | 1.2 | 42.2 | 60 | 4.4 | 157 |
| 103 | 60 | .05 | 29 | x | x | x | .01 | — | — | .05 | 1.2 | 42 | 60 | 4.2 | 146 |
| 106 | 60 | .05 | 30 | x | x | x | .01 | — | — | .05 | 1.2 | 42 | 60 | 4.2 | 156 |

(1)At best NOx value
(2)best NOx value corrected to 3% $O_2$
(3)x - no slot

Results for representative tests are presented in Table 1 and FIGS. 13–16. In Table 1, for each representative test, there are presented the number of oil orifices, oil orifice diameter, oil pressure, steam slot size, steam slot spacing, steam pressure, the smoke limit, and the level of NOx emissions. The test results presented in Table 1 were chosen based upon the test which gave the lowest NOx emissions, without smoke, for a particular burner tip configuration. The slot numbers and slot spacing numbers presented in Table 1 are based upon the numbering system used in FIG. 5. The NOx values are in parts per million (ppm) and have been corrected to 3% excess oxygen in order to eliminate the effect of flue gas dilution by oxygen. The combustion gas used was air, the control gas was steam, and the fuel was #4–6 low sulfur fuel oil.

The initial characterization of the low NOx burner was performed using the existing plant air register assembly. The tests were conducted to determine the effect of the number of and size of the oil orifices and control gas port size on NOx emission. The data generally showed that NOx emissions are sensitive to the level of fuel atomization. The variation in fuel atomization was achieved by changing the control gas exiting momentum and the size and number of oil orifices used.

To add to the testing flexibility, modification of the burner tip was then made to permit the change of the control gas port location. At this time, the register assembly of FIG. 12 was also installed in the boiler. Testing was resumed to determine the effect of the various burner operating variables on NOx emission.

The effect of control gas slot size and location on NOx emissions is illustrated by FIGS. 13 and 14. In FIG. 13, NOx emissions versus atomized pressure plots are presented using steam port widths of 0.02" and 0.05" with the ports located on both sides of the oil port flush with the oil port and at 1.25" away from the oil port. The plots show that a reduction in NOx emission was achieved using the wider 0.05" steam port than when using the 0.02" port. This reduction is attributed to coarser fuel atomization resulting from reduced steam exist momentum using a wider port.

Positioning the steam ports 1.25" away from the fuel port reduced fuel atomization and also resulted in an effective reduction in NOx emissions compared to positioning the steam ports flush with the fuel port. The incremental difference in NOx emissions experienced with 0.02" and 0.05" ports located flush (i.e., as close to the oil port as mechanically possible) with the oil port was progressively larger as steam pressure was increased. This showed that higher NOx emission level is associated with improved atomization of fuel.

The coarse atomization of fuel not only resulted in low NOx emissions, but it also resulted in a relatively high operating level of excess oxygen to avoid smoke emissions. This is illustrated by data obtained with a 0.02" steam slot located 1.25" away from the oil port (Test 65) in which the lowest achievable excess oxygen level progressively increased as the steam pressure was reduced. With a wider steam slot, a general increase in excess oxygen was also noted as a result of poor fuel atomization.

In addition to the poor atomization of fuel, a factor that contributed to high excess oxygen operation was the shielding effect of the atomization steam curtain injected behind the fuel on the wind box side of the flame. The presence of steam in this zone limited fuel mixing with combustion air and resulted in high excess oxygen operation. The steam shielding effect became more pronounced at low atomization levels where the effect of steam injection on fuel atomization was reduced. To eliminate this problem, and enhance low excess oxygen operation, a single atomization steam port located on the furnace side was used. NOx data were obtained using 0.01" steam port width with the control gas port located on the furnace side of the fuel port flush, 0.575", 0.20", and 1.825" away. The resulting NOx data are plotted versus steam pressure in FIG. 14.

In general, a reduction in operating level of excess oxygen was obtained using the single 0.01" steam port compared to the two steam ports configuration. The achieved reduction was dependent on steam port location. Using a single steam port also resulted in lower NOx emissions, which is partly attributed to lower excess oxygen level within the boiler furnace, as shown in FIG. 14. The highest NOx emission level was obtained with the steam port located flush with the oil port, and a progressive reduction in emissions was achieved as the steam port was moved away from the oil port. The optimum reduction in NOx and oxygen levels was obtained, as shown in FIG. 14, with a steam port located at 1.2" away from the oil port. It is believed that low excess oxygen operation was obtained with this firing configuration as a result of optimum burner flame profile which provided the appropriate level of mixing between combustion air and fuel. The reduction in NOx emissions obtained with this configuration is attributed to a complex interaction between injected steam, fuel/air mixture, and recirculated furnace gas within the core of the flame. It is also believed that the reduction in NOx was achieved due to the control gas intercepting the flame zone at the hottest portion of the flame zone, resulting in maximum reduction in thermal NOx formations.

From this series of tests, as represented in FIGS. 13 and 14, it was concluded that, for this furnace, the gas port should be from about 0.2 to about 1.5 inch away from a fuel port.

The use of a single control gas port on the furnace side provided a dynamic bluff-body that stabilized the burner flame. This ensured burner flame stability even with coarse fuel atomization. Locating the steam port a sufficiently large distance from the fuel port, and preferably at least about 0.3 inch, allowed the steam to intercept the flame at a desirable location to provide for localized quenching of the flame without adversely influencing the atomization characteristics of fuel. Spacing the steam slot at least 0.3 inch from the oil port also permitted use of high steam exiting velocities which provided high steam momentum at low steam consumption. The discharge of the steam from a continuous gap at a high momentum enhanced furnace gas recirculation to the flame which promoted low NOx operation and augmented flame stabilization.

The plots presented in FIG. 15 compare NOx emissions levels obtained using different steam port widths of 0.01, 0.02 and 0.05". All data were collected with atomization steam ports located at 1.2" away from the oil manifold. The plots show that both NOx emissions and operating level of excess oxygen are affected by steam momentum. The maximum reduction in NOx emission was obtained with the use of the 0.01" port width. A significant deterioration in operating level of excess oxygen coupled with an increase in NOx emissions was experienced with the use of a large steam port width (0.05"), i.e. low exiting steam momentum. The progressive increase in excess oxygen with the reduction in steam pressure for the 0.05" steam slot suggests that the deterioration was caused by poor fuel atomization. From this data it was concluded that preferably a control gas slot is no wider than about 0.05".

The consistent shift in NOx emissions and excess oxygen levels as a result of changing the control gas port size emphasizes the importance of this operating variable. At high steam pressure, the data show that an increase in both NOx emission and excess oxygen level can occur. This indicates that optimum NOx reduction is not only the result of the quenching effect of the steam, but is also affected by proper degree of fuel atomization, flame shaping, and, the location of the steam interception with the burner flame.

NOx emissions were found to be linearly dependent upon the operating level of excess oxygen. As excess oxygen within the boiler furnace was increased, a corresponding increase in NOx emissions occurred. The least squares fit of raw data for NOx versus oxygen to a straight line relationship was excellent, and the correlation coefficients of the fitted data for all tests performed were consistently in excess of 0.99.

The dependence of NOx emission on excess oxygen level ranged between 15–αppm per one percent change in excess oxygen and the bulk of the data were between 25–45 ppm. This dependence is far more moderate than the dependence displayed by conventional burners where the increase in NOx emissions generally range between 60–90 ppm per one percent change in excess oxygen. Minimizing NOx variation with excess oxygen is a desirable feature of the burner tip of the present invention for the following reasons:

1. It permits boiler operation within a narrow band of NOx emissions for relatively large variations of excess oxygen that can occur to accomodate changes in boiler cleanliness, fuel properties, boiler operating load, and number of burners out of service.
2. It allows low NOx levels to be achieved by off-stoichiometric firing by minimizing the contribution of upper burners rows to NOx emissions. The upper burners normally operate at fuel lean stoichiometry.
3. It minimizes the effect of combustion air maldistribution on NOx emissions in different types of boilers.

A plot of NOx emission level vs. excess oxygen at the smoke limit with (a) low NOx burner tips embodying features of the present invention and (b) the original equipment Peabody burner tips is presented in FIG. 16. Data presented for the Peabody burners were obtained during an extensive NOx optimization study using conventional combustion modification techniques. The emissions levels for the two type of burners are compared under both normal and off-stoichiometric modes of combustion. Test results are presented for boiler loads ranging between 41.5 and 43.5 MW. Off-stoichiometric combustion was obtained by taking the top middle burner out of service and biasing fuel distribution to the five burners remaining in service.

The data presented in FIG. 16 indicate that the low NOx burner of the present invention achieved a substantial reduction in NOx emissions over the Peabody burner in the normal mode of combustion. Furthermore, NOx emission levels demonstrated by the burner of the present invention under normal combustion were lower than that achieved by the Peabody burner operating under off-stoichimetric combustion. An additional reduction in NOx emissions to an impressively low level was demonstrated by the low NOx burner while operating under off-stoichiometric combustion. Comparing the low NOx burner performance under the normal mode of combustion to the Peabody burner under both normal and off-stoichiometric combustion, it is evident that the low NOx burner performance is superior overall, because the improved burner is capable of achieving substantially lower NOx emissions at a relatively low excess oxygen level.

NOx data presented for the low NOx and Peabody burners in FIG. 16 were obtained without the use of flue gas recirculation. Additional reduction in NOx emission levels demonstrated by the two burners is expected with the use of this NOx control technique.

NOx emission levels demonstrated by.the low NOx burner ranged between 146–160 ppm under normal combustion and between 134–149 ppm under off-stoichiometric combustion. A total of ten tests were performed for normal combustion to ensure the reproducibility of the results. Most of the test points plotted in FIG. 16 represented the arithmetic average of twelve discrete NOx samples taken at different locations within the boiler ducting. Values presented in the figure are therefore an integrated average of NOx concentration gradient within the flue gas. The time required to obtain all twelve samples ranged between 1½ to 2 hours, and hence, the obtained average represents NOx concentration under fairly stable combustion conditions.

More information regarding these tests is found in the following unpublished papers, which are filed with this application and are incorporated herein by reference:

Mansour, "Demonstration of SCE Low NOx Burner at Highgrove Generating Station", Sept. 21, 1978.

TRW, "Advanced Low NOx Burner Developments, Performance Period: March-June 1978." Final Report.

Example 2

This Example presents the results of tests conducted to determine the effectiveness of a burner tip according to the present invention on reducing NOx emissions from burning a high nitrogen content fuel.

The combustion facility used for the tests was a small-scale unit having a heat rating of up to $10\times10^6$ BTU/hr. FIG. 17 shows a schematic layout of the facility 400. The facility comprised a windbox 402, an air register assembly 404, a primary combustion chamber 406, an uncooled combustor extension 408, a cross-flow heat, exchanger 410, and an effluent exhaust stack 412. Combustion air was supplied to the combustor through a refractory lined windbox 402 of relatively large volume to dissipate swirl within the combustion air flow field. The air was then ducted to the primary combustion chamber through the air register assembly 404 which was designed to further minimize the swirl, maintain uniform combustion air velocity profile across the burner throat, and provide an axisymmetric combustion air envelope to surround the flame. The register design induced a parallel combustion air flow field. The primary combustion chamber consisted of a water jacketed cylindrical assembly three feet in internal diameter and fifteen feet long.

Combustion products exited the water cooled primary combustion chamber into the uncooled combustor extension 408. This extension was also three feet in diameter and fifteen feet long. The extension was installed to provide longer residence time for the reacting gases at elevated temperature and hence, minimize the tendency for smoke emission. Combustion air injection ports were provided at the entrance of the uncooled combustor extension to introduce secondary combustion air into the reacting gases in the event the burner was operated in the primary zone under fuel-rich stoichiometry. Capability to introduce secondary air at the exit of the extension section was also provided by the ducting arrangement in case longer residence time was desired under the fuel-rich conditions. Gaseous effluent exited the combustor extension through a cross-flow tube bundle type heat exchanger 410. Ambient air was introduced on the cool side of the heat exchanger by a high volume (5500 SCFM) and high pressure (2 psig) fan 420 which provided a source for preheated primary or secondary combustion air. The elevated temperature air from the heat exchanger was discharged to the atmosphere when not needed for the operation of the facility. Combustion air at ambient temperature was supplied to the combustor by another forced draft fan 422 rated at 4000 SCFM at 1 psig. The combustion air fan ducting was arranged so that flue gas recirculation from the combustor discharge, of up to 15% of the total combustion air volume, could be introduced with the combustion air.

The burner and burner tip used were as shown in FIGS. 8–10. The control gases used were steam, air, natural gas, and flue gas. Steam was supplied by a gas fired, 50 HP, York Shippley package boiler. High pressures for the air and flue gas were provided by a 100 SCFM Root compressor. The atomization flue gas was cooled to less than 200° F. in a water-cooled heat exchanger before it was introduced to the compressor. Natural gas was supplied from a utility natural gas supply line.

The fuels used included high nitrogen content (nominally 1.0%) synthetic fuel derived from coal, number 6 fuel oil, and diesel oil. Blends of these different fuels were also used.

The testing included evaluating NOx levels for different fuel blends under a variety of burner operating conditions. Burner variables tested included atomization pressures of 1.0, 1.5, 2.0, and 2.5 psig, and excess oxygen levels of 6.5, 7.1, 7.8, and 8.5%. For each of the atomization pressures, the minimum excess oxygen that was maintained without resulting in smoke emission, i.e. the "smoke limit", was determined.

Samples of the gaseous effluent were collected through five stainless steel, water-cooled probes located near the exit of the combustor extension. The probes were installed in a plane perpendicular to the products of combustion flow with one probe installed in the center of the combustor and the remaining four 90° apart in a circumferential arrangement. The gaseous constituents determined during the test program included oxygen, carbon dioxide, and NOx.

The effect of fuel bound nitrogen on NOx emissions was quantified by calculating the "conversion efficiency" of fuel bound nitrogen to NOx. This was done by calculating the incremental increase in NOx as a result of increasing the nitrogen weight fraction within a fuel blend. The variation in the nitrogen content in the fuel was obtained by blending the synthetic fuel with a low nitrogen content fuel such as diesel oil or number 6 fuel oil. In order to determine the incremental increase in NOx emission due to the fuel nitrogen, a base NOx emission level for each of the fuel blends without the presence of the nitrogen in the blend was determined. This was achieved by substituting diesel for synthetic fuel. The difference between NOx levels obtained by the combustion of the synthetic fuel and the diesel blends was therefore attributed to fuel produced NOx. Combustion calculations were then performed to determine NOx concentration in the flue gas (ppm corrected to 3% oxygen) that may result from the complete converstion of 1 by weight of fuel nitrogen to NOx. Since the ultimate analysis of the fuel blends changed with the variation in the synthetic fuel blend ratio, NOx concentrations at 1% fuel nitrogen conversion were calculated for each of the tested fuel blends. The converstion efficiency was then calculated according to the formula:

$$\text{Conversion Efficiency (percent)} = \frac{\Delta(NOx)}{\Delta N(NOx\ @\ 1\%)} \times 100$$

where:

ΔNOx is the increase in NOx emission attributed to fuel nitrogen (ppm corrected to 3% oxygen)

ΔN is the incremental increase in fuel nitrogen content (percent by weight) due to synthetic fuel blending. (NOx @1%) is the NOx concentration in the flue gases (ppm corrected to 3% oxygen) when 1.0% of fuel nitrogen is completely converted to NOx.

The data developed for the conversion of fuel bound nitrogen NOx are presented in FIG. 18. This data shows that the conversion of fuel nitrogen to NOx decays with the increase in the nitrogen content of the fuel. Fuel bound conversion efficiencies in the order of only 20% to 30% were obtained with the burner tip according to the present invention. Higher atomization pressure, and thus more fuel atomization, consistently produced high fuel nitrogen conversion to NOx. The impact of atomization pressure on the conversion of fuel nitrogen was more significant at low nitrogen concentrations than at high nitrogen concentrations. This explains why the controlled atomization obtained with the novel burner design of the present invention produced low NOx emissions.

The effect of the type of control gas used on the combustion qualities of pure synthetic fuel was also investigated. The gases tested consisted of air, steam, flue gas, and natural gas. The change in smoke limit and NOx emission as a function of control gas pressure obtained with each of the control gases are presented in FIGS. 19 and 20, respectively. The data presented in FIG. 19 show that a significant reduction in smoke limit was achieved in the case of steam and natural gas and was somewhat minimal for air and flue gas. The use of natural gas provided a significant reduction in smoke limit throughout the tested range of atomization pressures compared to the other gases used. A possible explanation for this reduction is that natural gas established gaseous flames which enhanced the prevaporization of the injected fuel and hence, improved its mixing and combustion efficiency.

While the smoke limit varied substantially as a function of atomization pressure and the type of control gas, the lowest NOx levels were consistently obtained with controlled fuel atomization. The minimum NOx levels were achieved, as shown in FIG. 20, with steam as the control gas and, in general, NOx levels progressively increased with higher atomization pressure except for air, where the NOx emissions decreased with improved atomization.

The data generated in this study are reported in more detail in a paper entitled "Factors Influencing NOx Production During the Combustion of Gulf's SRC-II" By M. N. Mansour, March, 1979, SCE Final Report No. 79-RD-7.

Example 3

This Example reports the results of tests that compare TRW low NOx burner tips with low NOx burner tips according to the present invention. The test facility used was the same as for Example 2. Six different burner tips were tested:

(1) Concentric steam/oil orifice (TRW design);
(2) Dual tip/outer ring fuel orifice design according to the present invention (herein referred to as fuel flush design);
(3) Dual tip concentric design (TRW design);
(4) Combination fuel flush/spray nozzle design; and
(5) Single row/outer ring fuel flush orifice design.

All of the burner tips used radial injection of the oil. In addition to radial introduction of fuel, burner tip 4 introduced fuel axially in a "conical" spray from the end of the burner tip. Several different methods of atomization were studied. Burner tips 2, 4, and 5 embody features of the present invention.

Burner tip 1, schematically shown in FIG. 21A, represented the state of the art at the beginning of the program reported herein as Example 3. Burner tip 1 comprised a dual ring of circumferential steam orifices with an outer burner tip diameter of 2.375 inches. The oil injection tip was located within the steam tip with orifices co-aligned with the steam orifices. The oil streams passed through a jacket of steam into the steam orifices where the accelerating steam flow sheared the relatively slow moving oil stream.

Burner tip 5, schematically shown in FIG. 21B, had the oil orifices distributed on the outer circumference of the burner tip. The atomizing gas was injected symmetrically in a double curtain from a continuous steam slot both upstream and downstream of the oil orifices. The points of fuel and steam injection were both flush with the outer diameter of the tip. Burner tip 5 was fabricated by using the burner 600 of FIG. 8 without the rear burner tip assembly 604 and the front manifold assembly 606.

Dual tip configurations (tips 2 and 3) of both burner tips 1 and 5 were fabricated and tested. Burner tips 2 and 3 are schematically shown in FIGS. 21C and 21D, respectively. With these dual tip designs, oil was injected and atomized in two spray patterns. Each spray was totally independent of the other. Two separate oil and steam supplies were provided by one burner gun assembly which contained four annular, concentric passages. In this way, oil and steam pressures could be changed at one tip without affecting the other tip.

The fourth tip, which is schematically shown in Fig. 21E, was prepared by securing a conventional water spray nozzle onto the end of a burner tip assembly 602 shown in FIG. 10. The spray nozzle injected oil in a concial pattern without steam atomization. The burner tip assembly 602 flame was upstream (on the wind box side) of the spray nozzle.

All the tips except the conical spary portion of tip 4 used steam to provide cooling of burner hardware. For this reason steam flowrates were maintained above 0.5 psig to avoid damaging the tips.

A configuration change which was peculiar to the fuel flush design involved cutting radial notches in the oil orifice ring which allowed atomizing steam to come closer to the orifice adjacent to the notch. This was done to help secure the flame to the tip by improving atomization near the tip.

Burner firing for each test was always started and ended on diesel oil in order to keep the fuel supply lines clear. Once a burner flame was established with diesel oil the supply was switched to a heated heavy oil (No. 6) tank. All tests were run at an oil flowrate of 1.2 GPM. This gave the burner a heat rating of 10 MMBTU/hour.

In most cases testing involved setting the control gas at the desired pressure and then adjusting the airflow inlet damper to the windbox until the smoke limit was reached. After allowing sufficient time for combustor to stabilize gas samples were taken and a complete emissions analysis was done. The next set of test conditions were achieved by raising the airflow, changing the control gas pressure, and then re-adjusting the airflow to the smoke limit or desired excess oxygen level. This procedure was repeated continually throughout a test day.

The following is a chronological synopsis of testing. The numbers in the left hand column refer to the five different tip configurations used.

| TIP | DESCRIPTION | TESTS | RESULTS |
|---|---|---|---|
| 1 | 30 Oil orifices - .025" DIA<br>Atomizing orifices - .100" DIA | 1–79 | Lowest NOx numbers achieved were: 149 ppm with steam atomization<br>137 ppm with air atomization<br>134 ppm with flue gas atomization |
| 2 | 30 Oil orifices - .025" DIA<br>Atomization slots - .010"<br>Varied distance between tips | 100–140 | Lowest NOx of 146 ppm with 10 psi atomization pressure<br>Most NOx levels in the 150–160 ppm range.<br>One Low NOx point of 121 ppm reached with flue gas atomization and unbalanced oil flow to fuel ports. (Test 139) |
| 3 | 30 Oil orifices - .025" DIA<br>Atomizing orifices - .100" DIA | 142–194 | Lowest NOx of 137 ppm reached with a Low (1 psi) control gas pressure. Most results above 150 ppm. |
| | Water and oil injection | 195–254 | Water was injected instead of oil through one of the tips.<br>Almost no NOx reduction was noticed although one test did reach 130 ppm NOx but with a very high water flowrate |
| 2 | 30 Oil Orifices - .025" DIA<br>Atomizing Slots - .005" and .020" | 255–283 | Lowest NOx of 138 ppm with .005" atomizing gap.<br>Lowest NOx of 133 with .020" gap. Putting all the oil through only one of the tips gave a low NOx level of 139 ppm. |

Through the first 289 tests the minimum NOx levels achieved were not reduced significantly from the 145–155 ppm range obtained with tip 1. This was true except for a few isolated points near 121 ppm which did not appear to be easily repeatable.

| TIP | DESCRIPTION | TESTS | RESULTS |
|---|---|---|---|
| 2 | 30 Oil orifices - .033" DIA Front (adjacent furnace)<br>30 Oil orifices - .025" DIA Back (adjacent wind-box)<br>Atomizing slots 0.02" front and back | 290–352 | The drop in NOx levels was dramatic. Numbers as low as 111 ppm were obtained (Test 341) and levels below 120 ppm were common and repeatable with many slots and pressures.<br>Excess $O_2$ levels were generally in the 4–5% range. Most of the Low NOx levels were achieved with about one third as much oil pressure on the front tip as on the back. |
| 3 | 30 Oil orifices<br>.033" DIA Front<br>.033" DIA Back<br>Atomizing orifices - 0.1" DIA | 353–371 | NOx levels could not be brought below 138 ppm. |
| 2 | 30 Oil orifices<br>.033" DIA Front<br>.033" DIA Back<br>Atomizing slots 0.02" front and back | 372–387 | Opened the oil orifices of the back tip to match those of the front. Low NOx levels were still reachable (114 ppm on test 378). |
| 4 | 15 Oil orifices - .033" DIA Back<br>Atomizing slot - .02" Back | 388–405 | Low NOx levels (113 ppm) could be reached but depended upon the ratio of oil flow between the tips. |
| 3 | 30 Oil orifices<br>.031" DIA Front | 406–415 | 142 ppm was the lowest |

-continued

| TIP | DESCRIPTION | TESTS | RESULTS |
|---|---|---|---|
| | .025" DIA Back | | NOx level possible with atomization as low as 1 psi. |
| | Atomizing orifices - 0.1" DIA | | |
| 2 | 30 Oil orifices | | |
| | .033" DIA Front | 416–475 | This tip was tested again to verify the earlier results. Also |
| | .033" DIA Back | | |
| | Atomizing slot | | |
| | .02" Front | 416–425 | different control gas gaps and pressures between tips were tested. |
| | .02" Back | | |
| | .01" Front | 426–436 | The low NOx levels were repeated with some added savings in excess $O_2$ level. |
| | .01" Back | | |
| | .005" Front | 437–450 | |
| | .005" Back | | |
| | .005" Front | 451–464 | |
| | .02" Back | | |
| | .02" Front | 465–475 | |
| | .005" Back | | |
| 5 | 48 Oil orifices - .025" DIA | 488–500 | NOx levels below 120 ppm were achieved with all of these tips. The smallest oil orifices showed the lowest excess $O_2$ levels. |
| | Atomizing slots - .02" | | |
| | 48 Oil orifices - .031" DIA | 516–528 | |
| | Atomizing slots - .01" | | |
| | 48 Oil orifices - .037" DIA | 548–557 | |
| | Atomizing slots - .02" | | |
| | 48 Oil orifices - .037" DIA | 573–587 | |
| | Atomizing slots - .01" | | |
| 2 | Notched - .038" DIA Back | 607–628 | $O_2$ levels came down but NOx went up. |
| | 24 Oil orifices - .055" DIA Front | | |
| | Atomizing slot - .01" Back | | |
| 2 | 30 Oil orifices | | |
| | .038" DIA Front | 501–515 | The lowest NOx achieved of 108 ppm was during these tests (Test 508). |
| | .033" DIA Back | | |
| | Atomizing Slots - .02" | | |
| | 30 oil orifices | | |
| | .038" DIA Front | 533–547 | The 120 ppm limit was broken with all of these tips but excess $O_2$ level increased with orifice size. |
| | .038" DIA Back | 558–564 | |
| | Atomizing Slots - .010" | | |
| | 30 oil orifices | | |
| | .046" DIA Front | 629–646 | |
| | .037" DIA Back | | |
| | Atomizing Slot - .020" | | |
| 3 | 30 Oil orifices | | |
| | .031" DIA Front | 529–532 | It was decided to try to run the tip without any atomization to see if NOx levels similar to tip 5 could be achieved. This was done on test 532 with 117 ppm. |
| | .025" DIA Back | | |
| 5 | Single row fuel flush | 588–606 | A single row tip with more orifices was tried. It was impossible to go below 120 ppm with this tip. |
| | 72 oil orifices - .025" DIA | | |
| | Atomizing slot | | |
| | .010" | 588–593 | |
| | .005" | 594–598 | |
| | .020" | 599–603 | |
| | .010" | 604–606 | |

As can be seen from the chart above, NOx emission levels below 120 PPM were eventually achieved with several of the burner tips that incorporate the present invention. Because of its simplicity and smooth operation tip 5 was singled out as the best tip tested.

Exemplary results with the burner tips 1 and 3 are presented in Table 2, and exemplary results obtained with burner tips 2 and 5 are presented in Table 3. As used in these tables, "front" means adjacent to the furnace while "back" means adjacent to the windbox. For burner tips 2 and 5, each fuel port is sandwiched in between two control gas slots. Representative data for the different burner tips are presented in FIG. 22. The data show that burner tips 2 and 5, embodying features of the present invention provide less NOx emissions and lower excess $0_2$ compared to prior art burner tips 1 and 3.

The following conclusions were drawn from the data developed in the tests of this Example.

Control gas pressure, control gas port size, oil orifice size, and the number of oil orifices are important parameters for NOx reduction.

The type of control gas has a negligible effect on NOx emissions.

For all tips tested the lowest atomization pressure (lowest atomization) leads to the lowest NOx.

The fuel flush tip design is superior to the prior art TRW design in reducing NOx and requiring a low level of control gas. The fuel flush design has no trouble with carbon formation.

TABLE 2

| PRIOR ART BURNER TIPS 1 AND 3 | | | | | | | | |
|---|---|---|---|---|---|---|---|---|
| Test | Steam Press (psig) | | Oil Press (psig) | | NOx | $O_2$ | Oil Orifice No./Dia. (in) | |
| No. | Front | Rear | Front | Rear | (ppm) | % | Front | Rear |
| 59 | 1.0 | — | 13.9 | — | 132 | 4.7 | | |
| 68 | 0.5 | — | 12.2 | — | 141 | 5.3 | | |
| 75 | 1.0 | — | 12.5 | — | 150 | 6.0 | | |
| 76 | 0.5 | — | 12.0 | — | 148 | 5.4 | 30/.025 | — |
| 77 | 0.5 | — | 13.5 | — | 134 | 4.5 | | |
| 78 | 0.5 | — | 12.2 | — | 143 | 4.6 | | |
| 79 | 1.0 | — | 13.1 | — | 137 | 4.5 | | |
| 146 | 1.0 | 1.0 | 15.5 | 15.5 | 138 | 5.7 | | |
| 146 | 2.0 | 2.0 | 15.8 | 15.8 | 146 | 5.3 | | |
| 162 | 1.0 | 1.0 | 18.0 | 18.0 | 152 | 6.1 | 15/.025 | 15/.025 |
| 166 | 1.0 | 1.0 | 16.5 | 16.5 | 137 | 5.9 | | |
| 170 | 2.0 | 2.0 | 17.0 | 17.0 | 151 | 5.7 | | |
| 529 | 1.0 | 1.0 | 15.0 | 15.0 | 138 | 6.4 | | |
| 530 | 0.5 | 0.5 | 13.5 | 13.5 | 139 | 5.3 | 15/.031 | 15/.025 |
| 531 | 0.0 | 0.0 | 14.5 | 14.5 | 129 | 4.5 | | |
| 360 | 1.0 | 1.0 | 9.0 | 9.0 | 138 | 4.0 | | |
| 361 | 0.5 | 0.5 | 9.0 | 9.0 | 138 | 3.7 | 15/.033 | 15/.033 |
| 364 | 1.0 | 1.0 | 9.0 | 9.0 | 139 | 4.2 | | |

TABLE 2-continued

| PRIOR ART BURNER TIPS 1 AND 3 | | | | | | | | |
|---|---|---|---|---|---|---|---|---|
| Test | Steam Press (psig) | | Oil Press (psig) | | NOx | $O_2$ | Oil Orifice No./Dia. (in) | |
| No. | Front | Rear | Front | Rear | (ppm) | % | Front | Rear |
| 367 | 1.0 | 1.0 | 9.0 | 9.0 | 153 | 5.0 | | |

TABLE 3

| LOW NOx BURNER TIPS 2 AND 5 | | | | | | | | | | |
|---|---|---|---|---|---|---|---|---|---|---|
| Test | Steam Press. (psig) | | Oil Press (psig) | | NOx | | Oil Orifice No./Dia. (in) | | Control Gas Slot size (in) | |
| No. | Front | Rear | Front | Rear | (ppm) | $O_2$% | Front | Rear | Front | Rear |
| 293 | 1.0 | 1.0 | 17.0 | 17.0 | 133 | 5.8 | 15/.033 | 15/.025 | .020 | .020 |
| 312 | 1.0 | 1.0 | 17.0 | 17.0 | 136 | 5.4 | | | .020 | .020 |
| 376 | 1.0 | 1.0 | 12.5 | 12.5 | 127 | 4.6 | | | .020 | .020 |
| 377 | 0.5 | 0.5 | 12.5 | 12.5 | 128 | 3.8 | | | .020 | .020 |
| 381 | 1.0 | 1.0 | 12.5 | 12.5 | 132 | 4.4 | | | .020 | .020 |
| 384 | 1.0 | 1.0 | 12.5 | 12.5 | 136 | 3.6 | | | .020 | .020 |
| 387 | 1.0 | 1.0 | 12.5 | 12.5 | 133 | 5.3 | 15/.033 | 15/.033 | .020 | .020 |
| 418 | 1.0 | 1.0 | 12.0 | 12.0 | 131 | 4.7 | | | .020 | .020 |
| 419 | 1.0 | 1.0 | 12.0 | 12.0 | 127 | 4.3 | | | .020 | .020 |
| 428 | 1.0 | 1.0 | 13.0 | 13.0 | 133 | 4.2 | | | .020 | .020 |
| 453 | 1.0 | 1.0 | 14.5 | 14.5 | 125 | 4.7 | | | .020 | .020 |
| 485 | 1.0 | — | 38.5 | — | 111 | 4.5 | | — | .010 | — |
| 486 | 1.0 | — | 38.5 | — | 116 | 5.0 | 48/.025 | — | .010 | — |
| 487 | 1.0 | — | 38.5 | — | 112 | 5.4 | | — | .010 | — |
| 490 | 1.0 | — | 39.0 | — | 130 | 5.4 | | — | .020 | — |
| 491 | 0.5 | — | 41.0 | — | 122 | 4.0 | 48/.025 | — | .020 | — |
| 492 | 0.25 | — | 42.5 | — | 121 | 3.7 | | — | .020 | |
| 498 | 1.0 | — | 36 | — | 116 | 3.4 | | — | .010 | — |
| 499 | 1.0 | — | 37 | — | 115 | 4.1 | 48/.025 | — | .010 | — |
| 500 | 1.0 | — | 38 | — | 113 | 3.3 | | — | .010 | — |
| 504 | 2.0 | 2.0 | 11 | 11 | 121 | 4.5 | 15/.038 | 15/.033 | .020 | .020 |
| 505 | 1.0 | 1.0 | 11 | 11 | 111 | 4.8 | | | .020 | .020 |
| 512 | 1.0 | 1.0 | 11 | 11 | 111 | 4.4 | 15/.038 | 15/.038 | .010 | .010 |
| 525 | 1.0 | — | 31.0 | — | 117 | 3.6 | 48/.031 | — | .020 | — |
| 536 | 2.0 | 2.0 | 8.5 | 8.5 | 126 | 4.8 | 15/.038 | 15/.038 | .010 | .010 |
| 537 | 1.0 | 1.0 | 9.0 | 9.0 | 115 | 4.1 | | | .010 | .010 |
| 553 | 1.0 | — | 26.5 | — | 136 | 4.7 | 48/.037 | — | .020 | .020 |
| 554 | 1.0 | — | 27.0 | — | 118 | 3.4 | | — | .020 | .020 |
| 561 | 2.0 | 2.0 | 9 | 9 | 126 | 4.0 | | | .020 | .020 |
| 562 | 1.0 | 1.0 | 9.5 | 9.5 | 118 | 3.0 | 15/.038 | 15/.038 | .020 | .020 |
| 563 | 0.5 | 0.5 | 9.5 | 9.5 | 112 | 2.9 | | | .020 | .020 |
| 631 | 2.0 | 2.0 | 5.0 | 5.0 | 126 | 3.5 | 15/.046 | 15/.046 | .020 | .020 |
| 632 | 1.0 | 1.0 | 5.5 | 5.5 | 121 | 4.0 | | | .020 | .020 |
| 644 | 1.0 | — | 9 | — | 121 | 4.7 | 15/.046 | — | .020 | — |
| 645 | 0.0 | — | 9 | — | 113 | 5.1 | | — | .020 | — |

Increasing the oil orifice diameter leads to lower NOx, but this effect is reduced with larger numbers of orifices.

If the oil orifices are too large it is possible to have the flame blow-off of the tip at low control gas pressures.

The data generated in this study are reported in more detail in a paper entitled "Low NOx Burner Development Program 38, Advanced LNB Program, Aug. 25, 1978, prepared by TRW.

VII. ADVANTAGES

Most of the advantages of the burner tip of the present invention and the method of its use have been discussed above. Principal among these advantages is the ability to burn a fuel with low NOx emission in a furnace.

Another advantage of the burner tip is that the flame profile formed exhibits excellent stability and a high degree of uniformity. Furthermore, the burner tip allows staged combustion where a high nitrogen content fuel can be burned with a low nitrogen fuel for supression of NOx emissions from the high nitrogen content fuel. In addition, even with the high nitrogen content fuel, the conversion efficiency of bound nitrogen is only in the order of 20%.

The burner tip of the present invention requires low usage of atomizing steam, and no carbon deposits are noted in the fuel orifices. It also has small size and low weight.

A particularly important feature is the ability to retrofit existing furnaces. Use of the burner tip of the present invention on existing furnaces will allow a return to normal boiler firing conditions in furnaces being operated under non-design conditions to avoid NOx emissions. This will eliminate many boiler problems caused by combustion modification techniques currently in practice. Among the potential results are increased capacity, reduced superheater and reheater attemperation rates, equalized burner firing rates, smooth and stable combustion, and reduced combustion induced boiler vibration.

Another advantage of the burner tip of the present invention is that the dependence of NOx emission on excess oxygen level is far more moderate than the dependence displayed by conventional burners. This insures boiler operation within a narrow band of NOx emissions for relatively large variations of excess oxygen.

While the present invention has been described in considerable detail with reference to certain preferred versions thereof, other versions are possible. Therefore the spirit and scope of the appended claims should not necessarily be limited to the description of the preferred versions contained herein.

What is claimed is:

1. A burner tip for burning of a liquid fuel in a combustion chamber containing a flame while suppresing the production of oxides of nitrogen, the combustion chamber including an opening, and means for introducing an oxygen containing combustion gas thereinto through said opening, the burner tip being located in the path of the oxygen containing gas as it passes through said opening and comprising:

(a) a fuel port and means for ejection of the liquid fuel without any atomization gas through said fuel port into the combustion chamber, the burner tip having a longitudinal axis and the fuel port being oriented so that the fuel is ejected into the combustion chamber at an angle generally perpendicular to the longitudinal axis of the burner tip and to the angle of introduction of the combustion gas; and (b) at least two gas ports in the burner tip, and means for introducing a control gas into the combustion zone at an angle generally perpendicular to the longitudinal axis of the burner tip and the angle of introduction of the combustion gas for controlled atomization of the liquid fuel, the gas ports being on axially opposite sides of the fuel port and axially spaced apart from the fuel port, at least one of the gas ports being axially spaced apart from the fuel port by at least 0.3 inch and no more than about 12 inches, said gas ports being oriented to direct gas in the same general direction as said fuel port.

2. The burner tip of claim 1 wherein both gas ports are axially spaced apart from the fuel port by at least about 0.3 inch and no more than about 12 inches.

3. The burner tip of claim 1 in which the fuel port comprises a plurality of orifices spaced apart circumferentially around the burner tip in a plane perpendicular to the longitudinal axis of the burner tip.

4. The burner tip of claim 3 in which the orifices have a diameter of from about 0.01 to about 0.1 inch.

5. The burner tip of claim 4 in which the orifices have a diameter of from about 0.02 to about 0.07 inch.

6. The burner tip of claim 5 in which the orifices have a diameter of about 0.05 inch.

7. The burner tip of claim 5 in which at least one orifice is from about 0.01 to about 0.05 inch larger in diameter than another orifice.

8. The burner tip of claim 1 in which the fuel port is oriented for ejection of the fuel into the combustion gas at an angle perpendicular to the direction of introduction of the combustion gas.

9. The burner tip of claim 1 in which at least one of the gas ports comprises a slot around the circumference of the burner tip.

10. The burner tip of claim 9 in which each slot is from about 0.01 to about 0.1 inch wide.

11. The burner tip of claim 10 in which each slot is from about 0.01 to about 0.05 inch.

12. The burner tip of claim 1 in which both gas ports are oriented for introduction of the control gas into the combustion chamber perpendicular to the longitudinal axis of the burner tip.

13. The burner tip of claim 1 in which the gas ports are laterally spaced apart from the fuel port a sufficient amount that the control gas does not intersect the fuel until the fuel enters the flame.

14. The burner tip of claim 1 in which the gas port is laterally spaced apart from the fuel port a sufficient amount that the control gas first intersects the fuel where the fuel enters the flame.

15. The burner tip of claim 1, wherein at least one of the gas ports is located so that the control gas intersects the flame at the portion of the flame closest to the combustion gas opening.

16. The burner tip of claim 1, the burner tip comprising at least three gas ports in the burner tip axially spaced apart from each other and from the fuel port for introducing control gas into the combustion chamber, wherein a pair of the gas ports is on either side of the fuel port with the fuel port therebetween, and wherein a third gas port is farther away from the opening for introducing the combustion gas then are the fuel port and the other two gas ports, the third gas port being axially spaced apart from the fuel port by at least about 0.3 inch.

17. The burner tip of claim 16 in which the third gas port is spaced apart from the fuel port by a distance of less than about 2 inches.

18. The burner tip of claim 16 in which the fuel port comprises a plurality of orifices spaced apart circumferentially around the burner tip.

19. The burner tip of claim 18 in which the orifices have a diameter of about 0.02 to about 0.07 inch.

20. The burner tip of claim 16 in which each gas port comprises a slot around the circumference of the burner tip.

21. The burner tip of claim 20 in which each slot is from about 0.01 to about 0.05 inch wide.

22. A burner tip for burning a first liquid fuel and a second liquid fuel in a combustion chamber containing a flame, the combustion chamber having an opening, and means for introducing an oxygen containing gas thereinto through said opening, the burner tip being located in the path of the oxygen containing gas as it passes through said opening and comprising:

(a) a first fuel port for ejecting the first fuel into the combustion gas without any atomization gas and a second fuel port for ejecting the second fuel into the combustion gas without any atomization gas, the burner tip having a longitudinal axis, the first and second fuel ports being axially spaced apart from each other, the first and second fuel ports being oriented for ejecting the fuels into the combustion zone at an angle generally perpendicular to the longitudinal axis of the burner tip and the angle of introduction of the combustion gas;

(b) conduit means connecting the first fuel port to a source for the first fuel;

(c) conduit means connecting the second fuel port to a source for the second fuel; and (d) a pair of gas ports for each fuel port and means for introducing a control gas through said gas ports into the combustion chamber at an angle generally perpendicular to the longitudinal axis of the burner tip and the angle of introduction of the combustion gas, each pair of gas ports being proximate to its respective fuel port, the gas ports being axially spaced apart from each other and from the fuel ports, one of the gas ports of each pair being axially spaced apart by at least about 0.3 inch and no more than about 12 inches from its respective fuel port, said gas ports being oriented to direct gas in the same general direction as said fuel ports.

23. The burner tip of claim 22 including means for introducing the same control gas through all of the gas ports.

24. The burner tip of claim 1, comprising at least two fuel ports.

25. A burner tip for burning a liquid fuel in a combustion chamber containing a flame while suppressing the production of oxides of nitrogen from burning of the fuel, the combustion chamber including an opening, and means for introducing an oxygen containing combustion gas thereinto through said opening, the burner tip being located in the path of the oxygen containing gas as it passes through said opening and comprising:

a fuel port for introduction of the liquid fuel into the combustion chamber, the burner tip having a longitudinal axis, the fuel port being oriented so that the fuel is introduced into the combustion chamber at an angle generally perpendicular to the direction of introduction of the combustion gas and generally perpendicular to the longitudinal axis of the burner tip; and at least two gas ports, and means for introduction of a control gas into the combustion chamber through said gas ports for controlled quenching of the flame and controlled atomization of the liquid fuel, the gas ports being oriented for introducing the control gas at an angle generally perpendicular to the longitudinal axis of the burner tip and the angle of introduction of the combustion gas, the gas ports being axially spaced apart from each other and from the fuel port and being on axially opposite sides of the fuel port, each gas port comprising a slot around the circumference of the burner tip, and wherein at least one gas port is axially spaced apart from the fuel port by at least about 0.3 inch and no more than 12 inches.

26. The burner tip of claim 25 wherein the distance between at least one gas port and the fuel port is a sufficient amount that control gas introduced from that gas port does not intersect the fuel until after the fuel enters the flame.

27. The burner tip of claim 25 wherein both gas ports are further away from the combustion gas opening than is the fuel port.

28. The burner tip of claim 25 wherein control gas intercepts the flame at the portion of the flame closest to the combustion gas opening for localized quenching of the flame.

29. The burner tip of claim 25 comprising at least three gas ports in the burner tip axially spaced apart from each other and from the fuel port, wherein a pair of the gas ports is on either side of the fuel port with the fuel port therebetween, and wherein a third gas port is further away from the combustion gas opening than is the fuel port and the other two gas ports, the third gas port being axially spaced apart from the fuel port by at least about 0.3 inch.

30. The burner tip of claim 29 in which the third gas port is axially spaced apart from the fuel port by a distance of less than about 2 inches.

31. The burner tip of claim 25 in which the fuel port comprises a plurality of orifices spaced apart from each other circumferentially around the burner tip.

32. The burner tip of claim 31 in which the orifices have a diameter of from about 0.02 to about 0.07 inch.

33. The burner tip of claim 32 in which the orifices have a diameter of about 0.05 inch.

34. The burner tip of claim 31 in which one orifice is from about 0.01 to about 0.05 inch larger in diameter than another orifice.

35. The burner tip of claim 25 in which the gas ports are slots and each slot is from about 0.01 to about 0.05 inch wide.

36. The burner tip of claim 22 in which each fuel port is axially spaced apart from its respective gas port by at least about 0.3 inch and no more than about 12 inches.

37. A burner tip for burning a liquid fuel in a combustion chamber containing a flame while suppressing the production of oxides of nitrogen, the combustion chamber having opening means for introducing an oxygen containing combustion gas thereinto, the burner tip having an axis extending longitudinally of the path of the oxygen containing combustion gas passing through said opening and comprising:

a fuel port for ejecting the fuel without any atomizing gas into the combustion zone radially, the fuel port comprising a plurality of orifices circumferentially spaced around the burner tip in a plane perpendicular to the longitudinal axis of the burner tip, the orifices having a diameter of from about 0.02 to about 0.1 inch; and at least three gas ports for the fuel port extending circumferentially around the burner tip for introducing steam into the combustion chamber for controlled quenching of the flame and for controlled atomization of the fuel, the gas ports being axially spaced apart from each other and from the fuel port, a pair of the gas ports being on either side of the fuel port with the fuel port therebetween, and a third gas port being further away from the means for introducing the combustion gas than are the fuel port and the other two gas ports, the third gas port being axially spaced apart from the fuel port by at least about 0.3 inch, at least one of the gas ports being no more than about 12 inches from the fuel port.

38. The burner tip of claim 37 in which at least one gas port comprises a slot around the circumference of the burner tip.

39. The burner tip of claim 38 in which the slot is from about 0.01 to about 0.05 inch wide.

40. A burner tip for burning a liquid fuel in a combustion chamber containing a flame while suppressing the production of oxides of nitrogen, the combustion chamber including an opening, and means for introducing an oxygen containing combustion gas thereinto through said opening, the burner tip having a longitudinal axis and being located in the path of the oxygen containing gas as it passes through said opening and comprising:

a fuel port for ejecting the liquid fuel without any atomizing gas into the combustion chamber radially and generally perpendicular to the angle of introduction of the combustion gas, the fuel port comprising a plurality of orifices circumferentially spaced around the burner tip in a plane perpendicular to the longitudinal axis of the burner tip, the orifices having a diameter of from about 0.01 to about 0.1 inch;

at least two slots extending circumferentially around the burner tip for introducing steam radially into the combustion chamber and generally perpendicular to the angle of introduction of the combustion gas for controlled quenching of the flame and for controlled atomization of the fuel, the slots being from about 0.01 to about 0.05 inch wide and on opposite sides of the fuel port, at least one slot being axially spaced apart from the fuel port by at least about 0.3 inch and no more than about 12 inches; and means for passing steam to the slots.

* * * * *